US007555233B2

(12) United States Patent
Shiobara et al.

(10) Patent No.: US 7,555,233 B2
(45) Date of Patent: Jun. 30, 2009

(54) FIXING DEVICE AND IMAGE FORMING APPARATUS

(75) Inventors: Toshimasa Shiobara, Tokyo (JP); Koji Aida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 429 days.

(21) Appl. No.: 11/039,920

(22) Filed: Jan. 24, 2005

(65) Prior Publication Data

US 2005/0163524 A1 Jul. 28, 2005

(30) Foreign Application Priority Data

Jan. 28, 2004 (JP) ..... 2004-019387
Nov. 2, 2004 (JP) ..... 2004-318958

(51) Int. Cl.
*G03G 15/20* (2006.01)

(52) U.S. Cl. ..... 399/69; 399/330; 399/331

(58) Field of Classification Search ..... 399/69
See application file for complete search history.

(56) References Cited

U.S. PATENT DOCUMENTS 5,735,604 A * 4/1998 Ewals et al. ..... 399/69
5,862,436 A * 1/1999 Ishizawa et al. ..... 399/69
6,314,252 B1 * 11/2001 Matsumoto ..... 399/69
6,647,218 B2 * 11/2003 Takayama ..... 399/69
6,654,571 B2 * 11/2003 Nanataki et al. ..... 399/69
6,724,999 B2 * 4/2004 Kikuchi et al. ..... 399/69
6,768,882 B2 * 7/2004 Omoto et al. ..... 399/69
7,062,187 B2 * 6/2006 Peng et al. ..... 399/69
2003/0123892 A1 * 7/2003 Kobayashi ..... 399/69
2004/0005163 A1 * 1/2004 Miura ..... 399/69

FOREIGN PATENT DOCUMENTS

JP 2001-242741 9/2001

* cited by examiner

*Primary Examiner*—Timothy J Dole
(74) *Attorney, Agent, or Firm*—Rabin & Berdo, PC

(57) ABSTRACT

A fixing device includes a non-contacting thermistor (54) disposed in the vicinity of the surface of a heat roller (21) and an upper cover temperature thermistor (60) for detecting the temperature of a pressure roller (22). The calculated surface temperature (T) of the heat roller 21 is calculated based on the detected temperature (T1) detected by the non-contacting thermistor (54), the detected temperature (T2) detected by the upper cover temperature thermistor (60), the distance (L1) from the non-contacting thermistor (54) to the surface of the heat roller (21) and the distance (L2) from the non-contacting thermistor (54) to the upper cover (51).

16 Claims, 20 Drawing Sheets

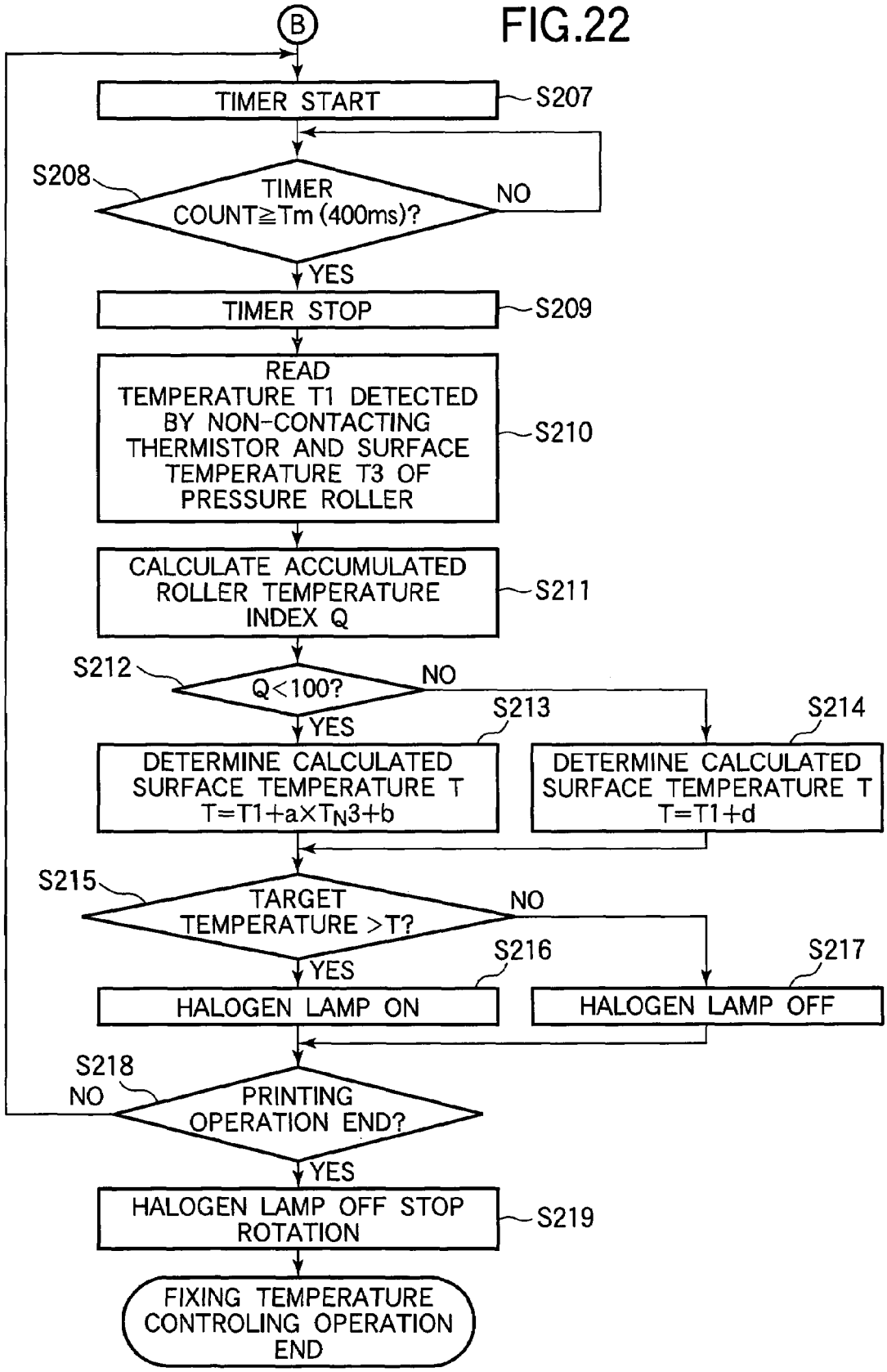
FIG.22
B
TIMER START
S207
S208
TIMER COUNT≧Tm (400ms)?
NO
YES
TIMER STOP
S209
READ TEMPERATURE T1 DETECTED BY NON-CONTACTING THERMISTOR AND SURFACE TEMPERATURE T3 OF PRESSURE ROLLER
S210
CALCULATE ACCUMULATED ROLLER TEMPERATURE INDEX Q
S211
S212
Q<100?
NO
YES
S213
DETERMINE CALCULATED SURFACE TEMPERATURE T T=T1+a×TN3+b
S214
DETERMINE CALCULATED SURFACE TEMPERATURE T T=T1+d
S215
TARGET TEMPERATURE >T?
NO
YES
S216
HALOGEN LAMP ON
S217
HALOGEN LAMP OFF
S218
NO
PRINTING OPERATION END?
YES
HALOGEN LAMP OFF STOP ROTATION
S219
FIXING TEMPERATURE CONTROLING OPERATION END

FIXING DEVICE AND IMAGE FORMING APPARATUS

BACKGROUND OF THE INVENTION

This invention relates to a fixing device and an image forming apparatus, and particularly relates to a temperature controlling system of a heating member heated by a heat source.

In order to control the surface temperature of a heat roller (i.e., a heating member), a conventional fixing device has a non-contacting temperature sensor in the proximity of the outer surface of the heat roller, and turns on and off a heat source of the heat roller according to the temperature detected by the non-contacting temperature sensor. The detected temperature of the heat roller is compensated based on a printing condition (for example, a continuous printing operation) a change in the detected temperature (increasing or decreasing) or the like. Such an image forming apparatus is disclosed by, for example, Japanese Laid-Open Patent Publication No. 2001-242741 (see page 1 and FIG. 1).

However, because of the influence of the ambient temperature (for example, the temperature of a cover of the fixing device), the difference between the detected temperature detected by the non-contacting temperature sensor and the actual surface temperature of the heat roller may deviate, and therefore incorrect detection of the temperature may occur. In such a case, it is difficult to compensate the incorrect detection of the temperature.

SUMMARY OF THE INVENTION

An object of the present invention is to provide a fixing device and an image forming apparatus capable of correctly controlling a surface temperature of a heating member for heating a recording medium by obtaining a correct temperature of the heating member irrespective of the environmental factors of the fixing device.

According to the invention, there is provided a fixing device for fixing a developer image to a recording medium. The fixing device includes a heat source, a heating member heated by the heat source for heating the recording medium, a first temperature detecting unit that detects a temperature of the heating member and is remote from the heating member, a second temperature detecting unit provided in the proximity of the first temperature detecting unit, and a control unit that controls the heat source according to detected temperatures detected by the first and second temperature detecting units.

With such an arrangement, it becomes possible to correctly calculate the surface temperature of the heating member of the fixing device irrespective of the condition of the fixing device, even when the surface temperature of the heating member is detected by a non-contacting detecting unit. Therefore, it becomes possible to accomplish the fixing device and the image forming apparatus capable of correctly controlling the surface temperature of the heating member.

BRIEF DESCRIPTION OF THE DRAWINGS

In the attached drawings:

FIG. 22 is a flow chart illustrating the temperature controlling operation of the fixing device performed by the printing controller based on the calculated surface temperature obtained by the equation (3) or (5) selected according to the accumulated roller temperature index in Embodiment 4;

DETAILED DESCRIPTION OF THE PREFERRED EMBODIMENT

Embodiments of the present invention will be described with reference to the attached drawings.

Embodiment 1

Figure 1:
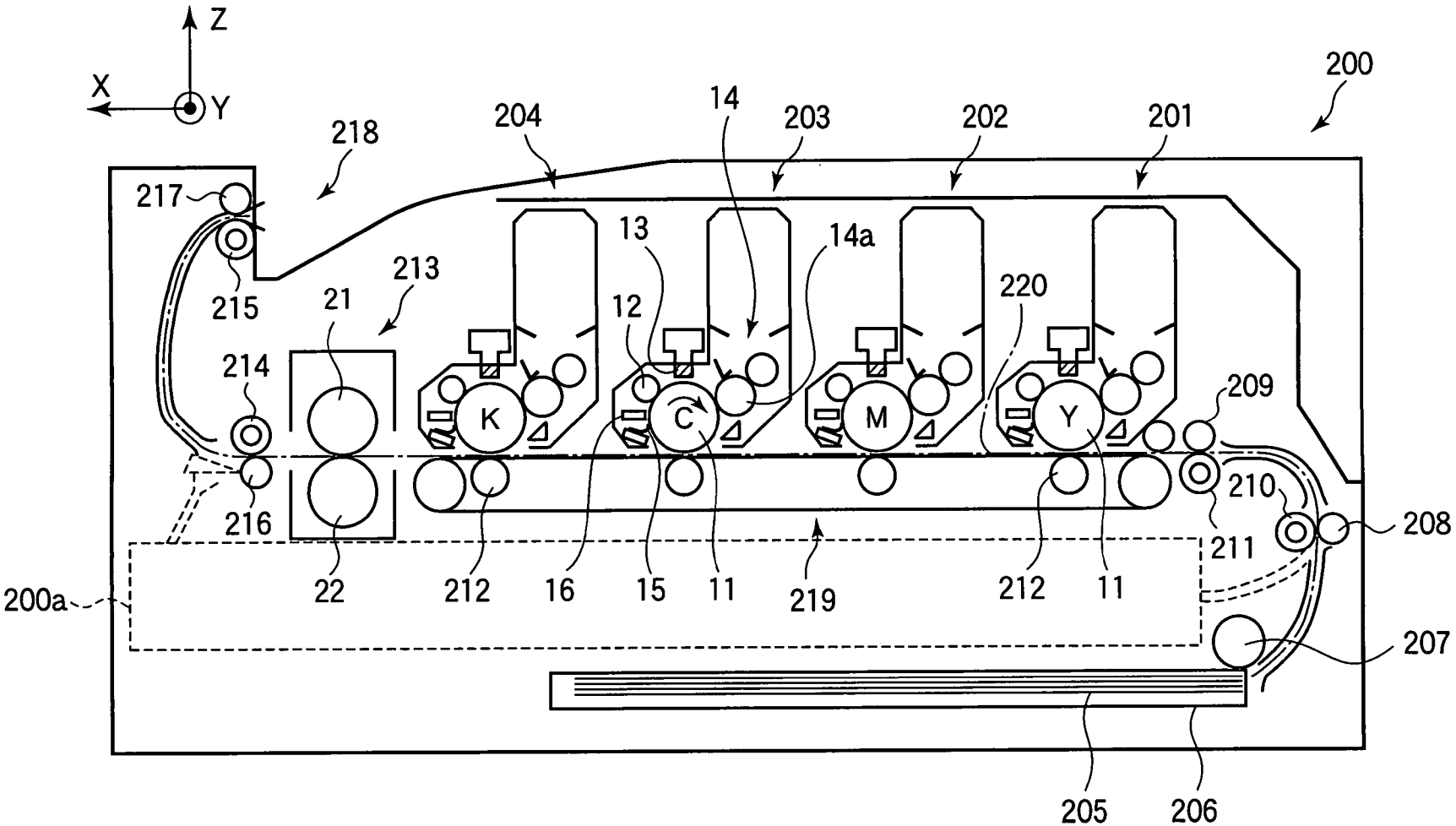
FIG. 1 is a schematic view of an image forming apparatus having a fixing device according to Embodiment 1 of the present invention.

FIG. 1 is a side view illustrating the structure of an image forming apparatus having a fixing device according to Embodiment 1 of the present invention.

In FIG. 1, the image forming apparatus 200 includes a four detachable process units 201, 202, 203 and 204 respectively forming images of yellow, magenta, cyan and black on a recording medium 205. The process units 201 through 204 are arranged in this order from the upstream side to the downstream side of a feeding path 220 of the recording medium 205. The process units 201 through 204 have common internal structures, and therefore the internal structure of the cyan process unit 203 will be described. A part of the image forming apparatus 200 other than the detachable process units 201 through 204 is referred to as a main body.

The process unit 203 includes a photosensitive drum 11 that rotates in a direction indicated by an arrow. Along the circumference of the photosensitive drum 11, a charging roller 12, an exposing device 13, a developing device 14, a cleaning blade 15 and a static eliminator 16 are disposed in this order in the rotational direction of the photosensitive drum 11. The charging roller 12 uniformly charges the surface of the photosensitive drum 11 by applying electric charge to the surface of the photosensitive drum 11. The exposing device 13 includes an LED (Light Emitting Diode) that irradiate the uniformly charged surface of the photosensitive drum 11 with light to form a latent image thereon. The developing device 14 includes a developing roller 14*a* that develops the latent image on the surface of the photosensitive drum 11 with cyan toner. The cleaning blade 15 removes the residual toner that has not been transferred to the recording medium 205 but remains on the surface of the photosensitive drum 11. The static eliminator 16 removes the deviation of the electric potential of the surface of the photosensitive drum 11. The photosensitive drum 11, the charging roller 12, the developing roller 14*a* are rotated by a power generated by a driving source (not shown) and transmitted by gears or the like.

A cassette 206 is attached to the lower part of the image forming apparatus 200 includes a cassette 206. A stack of the recording media (for example, papers) 205 is accommodated in the cassette 206. The image forming apparatus 200 includes a hopping roller 207 disposed on the upper side of the cassette 206 for feeding the recording medium 205 of the cassette 206 one by one. A feeding roller 210 and a pinch roller 208 are disposed on downstream side of the hopping roller 207 in the feeding direction of the recording medium 205. The feeding roller 210 and the pinch roller 208 nip the recording medium 205 and further feed the recording medium 205. A resist roller 211 and a pinch roller 209 are disposed on downstream side of the feeding roller 210 and the pinch roller 208 in the feeding direction of the recording medium 205. The resist roller 211 and the pinch roller 209 nip the recording medium 205, correct the skewing of the recording medium 205, and feed the recording medium 205 to the process unit 201. The hopping roller 207, the feeding roller 210 and the resist roller 211 are rotated by a power generated by a driving source (not shown) and transmitted by gears or the like.

Transfer rollers 212 are respectively provided in opposition to the photosensitive drums 11 of the process units 201 through 204. The transfer roller 212 is composed of conductive rubber. A voltages is applied to each transfer roller 212 so as to generate a difference in electric potential between the surface of the photosensitive drum 11 and the surface of the transfer roller 212 when the toner image is to be transferred from the photosensitive drum 11 to the recording medium 205. The process units 201 through 204 and the transfer rollers 212 constitute an image forming unit for forming the toner image (i.e., developer image) on the recording medium.

The image forming apparatus 200 includes a fixing unit 213 at the downstream side of the process units 201 through 204. The fixing unit 213 includes a heat roller (i.e., a heating member) 21 and a pressure roller 22, and fixes the toner image (having been transferred to the recording medium 205) to the recording medium 205. An eject roller 214 and a pinch roller 216 are disposed at the downstream side of the fixing unit 213, and nip the recording medium 205 therebetween. An eject roller. 215 and a pinch roller 217 are disposed at the downstream side of the eject roller 214 and the pinch roller 216, and nip the recording medium 205 therebetween. The eject rollers 214 and 215 and the pinch rollers 216 and 217 eject the recording medium 205 (having been fed out of the fixing unit 213) to a stacker portion 218. The heat roller 21 and the eject rollers 214 and 215 are rotated by a power generated by a driving source (not shown) and transmitted by gears or the like. A belt feeding device 219 is disposed at the lower side of the process units 201 through 204. The belt feeding device 219 feeds the recording medium 205 (having fed by the resist roller 211) along a feeding path through the process units 201 through 204. The belt feeding device 219 further feeds the recording medium 205 to the fixing roller 213. The belt feeding device 219, the hopping roller 207, the pinch rollers 208 and 209, the feeding roller 210, the resist roller 211, eject rollers 214 and 215, and the pinch rollers 216 and 217 constitute a feeding mechanism that feeds the recording medium.

As shown in FIG. 1, X-axis is defined as being parallel to the feeding direction of the recording medium 205 passing through the process units 201 through 204. Y-axis is defined as being parallel to the rotation axis of the photosensitive drum 11. Z-axis is defined as being perpendicular to the X-axis and Y-axis. In the other figures in which XYZ coordination is shown, the X-axis, Y-axis Z-axis respectively indicate the directions as shown in FIG. 1. As indicated by a broken line in FIG. 1, the image forming apparatus 200 includes a mechanism 200*a* that turns the recording medium 205 upside down for a double side printing. The detailed description of the mechanism 200*a* is omitted.

Figure 2:
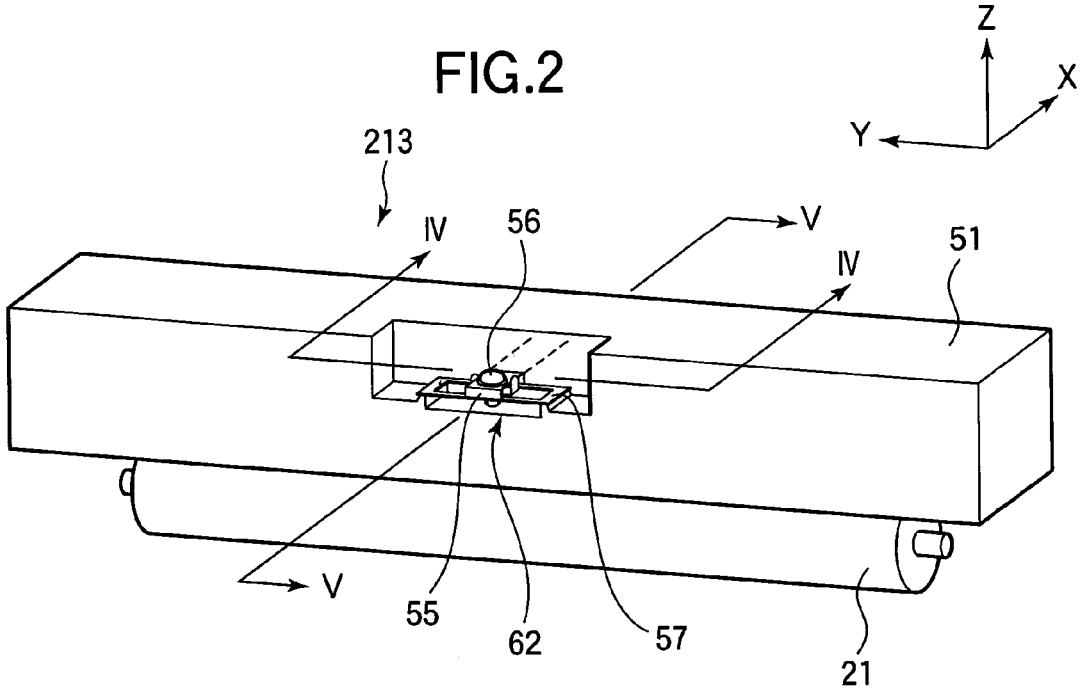
FIG. 2 is a top perspective view of an upper cover and a heat roller of the fixing device according to Embodiment 1.
Figure 3:
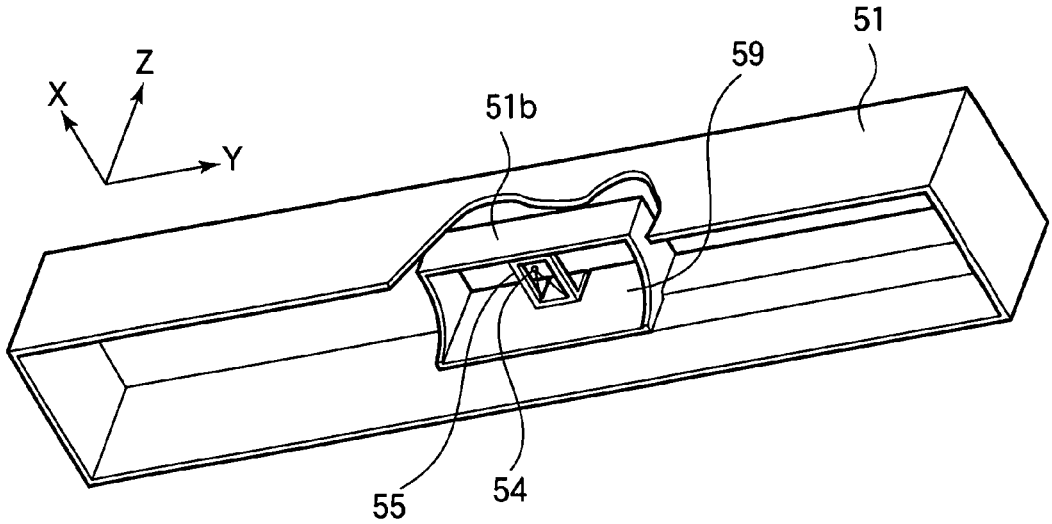
FIG. 3 is a bottom perspective view illustrating the inside of the upper cover shown in FIG. 2.
Figure 4:
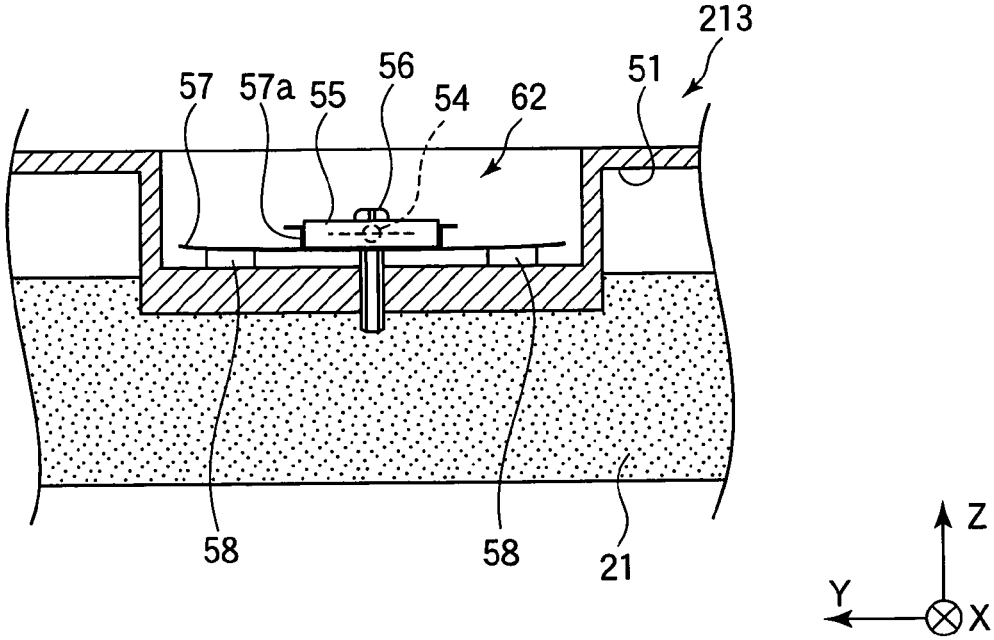
FIG. 4 is a sectional view of a mechanism for adjusting the position of a non-contacting thermistor, taken along Line IV-IV shown in FIG. 2.
Figure 5:
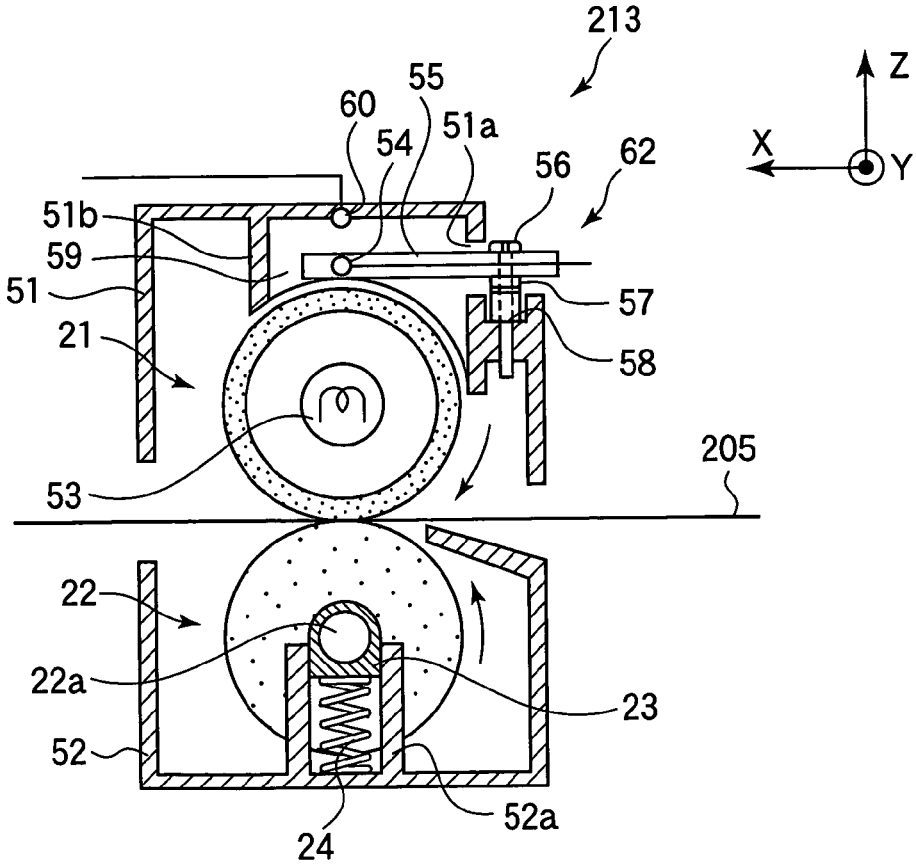
FIG. 5 is a sectional view of the fixing device, taken along Line V-V shown in FIG. 2.

FIG. 2 is a top perspective view of an upper cover 51 and the heat roller 21 of the fixing unit 213 according to Embodiment 1. FIG. 3 is a bottom perspective view of the upper cover 51 for illustrating the inside of the upper cover 51. FIG. 4 is a sectional view illustrating a structure of a position adjusting mechanism 62 of a non-contacting thermistor 54, taken along a line IV-IV shown in FIG. 2. FIG. 5 is a sectional view of the fixing unit 213, taken along a line V-V shown in FIG. 2.

As shown in FIG. 5, the fixing unit 213 includes the heat roller 21 driven by a fixing motor (FIG. 6) to rotate in the direction indicated by an arrow, and the pressure roller 22 that rotates following the rotation of the heat roller 21. Each of the heat roller 21 and the pressure roller 22 has a cylindrical shape. A rotation shaft 22*a* of the pressure roller 22 is rotatably supported by movable bearings 23 (FIG. 5) supported by movement guides 52*a* formed on a lower cover 52 of the fixing unit 213. The movable bearings 23 are movable in the vertical direction, and urged upward (i.e., toward the heat roller 21) by compression springs 24. The pressure roller 22 rotates together with the heat roller 21 in such a manner that the outer surface of the pressure roller 22 is urged against the outer surface of the heat roller 21 with a predetermined force.

A halogen lamp (i.e., a heat source) 53 is provided in the heat roller 21. The halogen lamp 53 has a cylindrical shape extending in the direction of the rotation axis of the heat roller 21, and has a resilient layer made of, for example, rubber. The surface temperature of the heat roller 21 is controlled by turning on and off the halogen lamp 53 at timings as described later. The non-contacting thermistor 54 corresponds to a first temperature detecting unit. In order to detect the surface temperature of the heat roller 21, the non-contacting thermistor 54 is held at a tip of a sensor frame 55 and is disposed at the proximity of the outer surface of the heat roller 21. The sensor frame 55 is supported by a position adjusting mechanism 62 provided on the outside of the upper cover 51. The sensor frame 55 protrudes through an opening 51*a* to the inside of the upper cover 51, and supports the non-contacting thermistor 54 at the tip thereof.

The position adjusting mechanism 62 includes a plate spring 57, a pair of supporting members 58 (FIG. 4) that support both ends of the plate spring 57, and a frame holding portion 57*a* provided on the center of the plate spring 57 for supporting the sensor frame 55. The position adjusting mechanism 62 further includes an adjusting screw 56 that protrudes the sensor frame 55 and the frame holding portion 57*a* and engages a threaded hole formed on the upper cover 51. By rotating the adjusting screw 56 to adjust the height of the sensor frame 55, the distance between the non-contact thermistor 54 (mounted on the tip of the sensor frame 55) and the surface of the heat roller 21 can be adjusted. The sensor frame 55 is urged against the adjusting screw 56 by a recovering force of the plate spring 57 so that the height of the sensor frame 55 is maintained.

A closed space 59 (see FIG. 3) is formed in the upper cover 51 into which the sensor frame 55 protrudes. The closed space 59 is surrounded by a partition wall 51*b* and a part (for example, a top) of the circumferential surface of the heat roller 21. A cover temperature detecting thermistor (i.e., a second temperature detecting unit) 60 is fixed to a ceiling of the closed space 59 for detecting the temperature of the upper cover 51. The closed space 59 prevents the influence of the atmospheric flow from being exerted on the detection of the non-contacting thermistor 54. The non-contacting thermistor 54 and the cover temperature detecting thermistor 60 are arranged substantially along a line perpendicular to a tangential plane of a part (for example, a top) of the circumferential surface of the heat roller 21.

Figure 6:
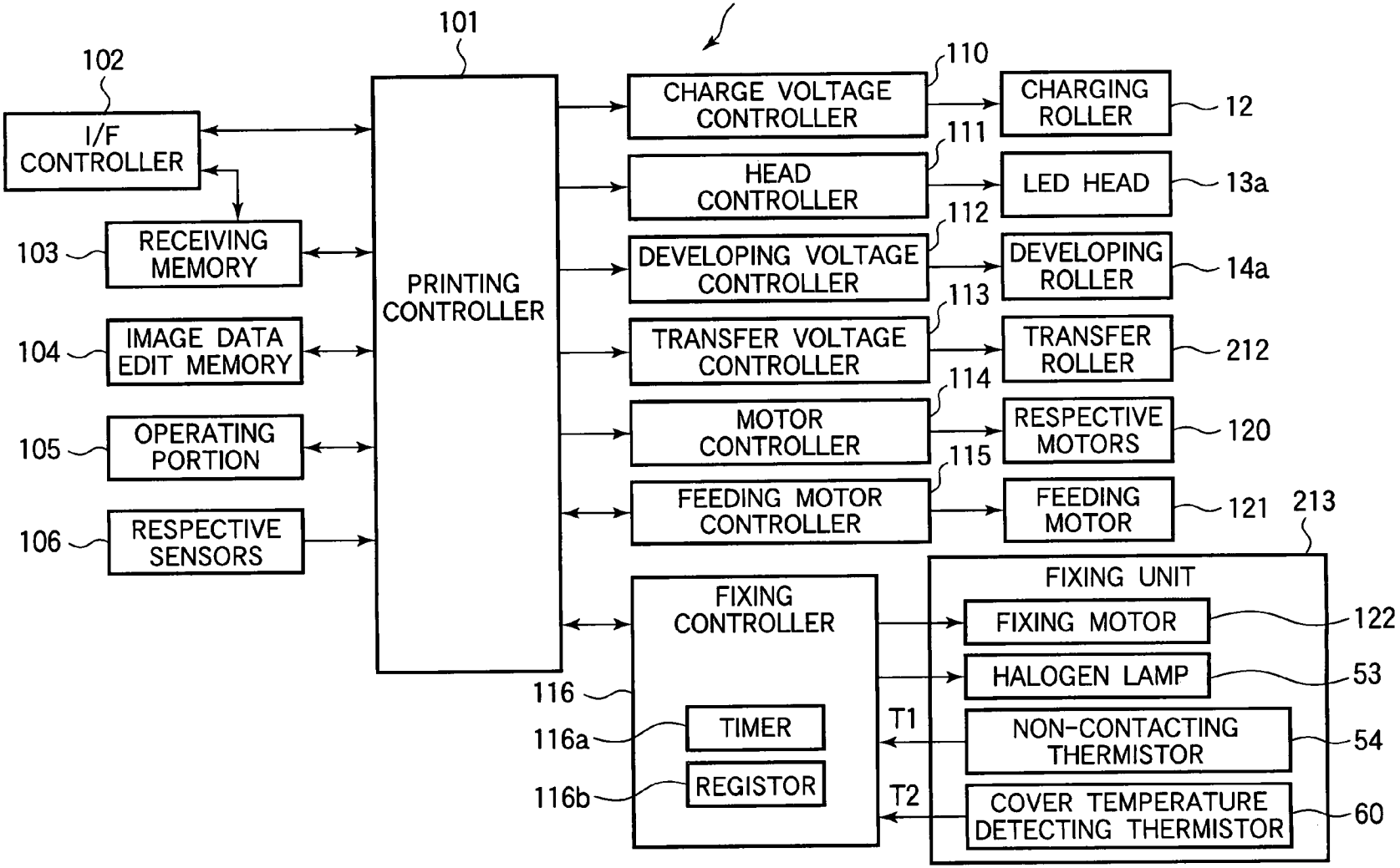
FIG. 6 is a block diagram illustrating a control system of an image forming portion of the image forming apparatus.

FIG. 6 is a block diagram illustrating the control system of an image forming portion 100 of the image forming apparatus 200. A printing controller 101 includes a microprocessor, a ROM, a RAM, an input port, a timer or the like. The printing controller 101 receives printing data and control command from a not shown superior device, and sequentially controls the whole image forming portion 100 to perform a printing operation. An I/F controller 102 sends signal of the image forming portion 100 to the superior device, receives the signal from the superior device, and processes (and analyzes) the received signal. A receiving memory 103 stores the respective image data (sent from the superior device) of yellow (Y), magenta (M), cyan (C), and black (B) under the control of the I/F controller 102. An image data edit memory 104 stores the image data edited by the printing controller 101 according to the printing data.

An operating portion 105 has an LED which displays a condition of the image forming portion 100 and a switch by which a user inputs a command to the image forming portion 100. Respective sensors 106 include a plurality of sensors for detecting the presence of the belt feeding device of the recording medium, a sensor for detecting a temperature and humidity in the image forming apparatus, a density sensor for detecting a density of the toner image. The outputs from these sensors are inputted into the printing controller 101.

Charge voltage controllers 110 respectively apply voltages to the charging rollers 12 to thereby charge the surfaces of the photosensitive drums 11 (FIG. 1). Although one charge voltage controller 110 and one charging roller 12 are shown in FIG. 6, four charge voltage controllers 110 and four charging rollers 12 are provided for individually charging the photosensitive drums 11 of yellow, magenta, cyan and black as shown in FIG. 1.

Head controllers 111 respectively control the LED heads 13*a* of the exposing devices 13 (FIG. 1) according to the image data stored in the image data edit memory 104 so that the exposing devices 13 expose the surfaces of the photosensitive drums 11 with light to form latent images thereon. Although one head controller 111 and one LED head 13*a* are shown in FIG. 6, four head controllers 111 and four LED heads 13*a* are provided for individually exposing the surfaces of the photosensitive drums 11 of yellow, magenta, cyan and black as shown in FIG. 1.

Developing voltage controllers 112 respectively control the voltages applied to the developing rollers 14*a* of the developing devices 14 (FIG. 1) according to the instruction from the printing controller 101 so that toner adheres to the latent images on the photosensitive drums 11 to form toner images. Although one developing voltage controller 112 and one developing roller 14*a* are shown in FIG. 6, four developing voltage controllers 112 and four developing rollers 14*a* are provided for individually forming toner images on the photosensitive drums 11 of yellow, magenta, cyan and black as shown in FIG. 1.

Transfer voltage controllers 113 respectively apply voltages to the transfer rollers 212 (FIG. 1) according to the instruction from the printing controllers 101 so as to transfer the toner images from the photosensitive drums 11 to the recording medium 205 (FIG. 1). Although one transfer voltage controller 113 and one transfer roller 212 are shown in FIG. 6, four transfer voltage controllers 113 and four transfer rollers 212 are provided for individually transferring the toner images from the photosensitive drums 11 of yellow, magenta, cyan and black to the recording medium as shown in FIG. 1.

A motor controller 114 controls respective motors 120 according to the instruction from the printing controllers 101. The respective motors 120 include a unit motor for rotating the photosensitive drum 11 (FIG. 1) the charging roller 12 and the developing roller 14*a* and a belt motor for moving the belt feeding device 219.

A feeding motor controller 115 controls a feeding motor 121 that drives the hopping roller 207 (for feeding the recording medium 205 out of the cassette 206), the feeding roller 210 and the resist roller 211 (for further feeding the recording medium 205 to the belt feeding device 219), and the eject rollers 214 and 215 (for ejecting the printed recording medium 205).

A fixing controller 116 controls the fixing unit 213 (FIG. 5) that fixes the transferred toner image to the recording medium 205. The fixing controller 116 controls the voltage applied to the halogen lamp 53 in the heat roller 21 according to the instruction from the printing controller 101. The fixing controller 116 receives the detected temperatures T1 and T2 from the non-contacting thermistor 54 for detecting the surface temperature of the heat roller 21 and the cover temperature detecting thermistor 60 for detecting the temperature of the upper cover 51. Based on the detected temperatures T1 and T2, the fixing controller 116 controls the halogen lamp 53 by turning on and off the halogen lamp 53. The fixing controller 116 further controls a fixing motor 122 for rotating the heat roller 21 when the temperature of the heat roller 21 exceeds a predetermined temperature. The fixing controller 116 includes a timer 116*a* for counting an interval of the temperature detection and an interval of the temperature controlling as described later, a resistor 116*b* for storing a fixing target temperature.

The operation of the image forming portion 100 of the image forming apparatus 200 constructed as above will be described.

The printing controller 101 receives a control command form the superior device via the I/F controller 102. Then, the printing controller 101 sends the instruction to the fixing controller 116 so that the fixing controller 116 determines whether the surface temperature T of the heat roller 21 (FIG. 5) is within a predetermined range in which the heat roller 21 is operable, according to the detected temperature of the non-contacting thermistor 54 and the cover temperature detecting thermistor 60. If the detected temperature is lower than the predetermined range, the fixing controller 101 turns on the halogen lamp 53 and keeps heating the heat roller 21 until the temperature of the heat roller 21 reaches the predetermined temperature. When the detected temperature of the heat roller 21 reaches the predetermined temperature, the fixing controller 116 sends the instruction to the fixing motor 122 to rotate the heat roller 21. The rotation of the heat roller 21 and the temperature controlling operation of the heat roller 21 can be performed at the same time.

Then, the motor controller 114 drives the unit motor for rotating the photosensitive drums 11 (FIG. 1), the charging rollers 12 and the developing rollers 14 and drives the belt motor for driving the belt feeding device 219. Further, the controller 101 controls the charge voltage controllers 110, the developing voltage controllers 112 and the transfer voltage controllers 113 to apply predetermined voltages to the charging rollers 12, the developing rollers 14*a* and the transfer rollers 212 of yellow (Y), Magenta (M), Cyan (C) and Black (B).

The printing controller 101 sends the instruction to the feeding motor controller 115 to start feeding of the recording medium 205 accommodated in the cassette 206.

The printing controller 101 checks the timing (by means of a not shown detecting sensor) when the recording medium 205 reaches a predetermined position in which the toner image can be formed on the recording medium 205. When the recording medium 205 reaches the predetermined position, the printing controller 101 reads the image data from the image data edit memory 104 and sends the image data to the head controllers 111. Each head controller 111 receives the image data of one line, and sends latch signal to the LED head 13*a* of the exposing device 13 so that the LED head 13*a* stores the image data. The head controller 111 sends print signal STB to the LED head 13*a*. The LED head 13*a* starts the exposure by one line according to the stored image data.

The LED head 13*a* exposes the negatively charged surface of the photosensitive drum 11, so as to form the latent image composed of dots having electric potential raised by the exposure. The negatively charged toner adheres to the dots because of the electric attractive force, with the result that the toner image is formed on the surface of the photosensitive drum 11. By the rotation of each photosensitive drum 11, the toner image reaches a transferring portion between the photosensitive drum 11 and the transfer roller 212. The printing controller 101 sends instruction to the transfer voltage controller 113 so that a positive high voltage (i.e., a transferring voltage) is applied to the transfer roller 212. As a result, the transfer roller 212 transfers the image data from the photosensitive body 11 to the recording medium 205 passing through the transferring portion.

The exposure of the photosensitive body 11, the formation of the toner image and the transferring of the toner image are performed in each of the process units 201 through 204 when the recording medium 205 reaches the process units 201 through 204, with the result that the toner images of yellow (Y), magenta (M), cyan (C) and black (B) are successively transferred to the recording medium 205 and overlap with each other.

The recording medium 205 (to which the toner image has been transferred) is fed to the fixing unit 213. When the recording medium 205 passes through the heat roller 21 and the pressure roller 22 urged against each other and rotating with each other, the recording medium 205 is heated and pressed, with the result that the toner image is fixed to the recording medium 205. The recording medium 205 (to which the toner image is fixed) is further fed by the eject rollers 214 and 215 and the pinch rollers 216 and 217 to the outside of the image forming apparatus 200, and is placed on the stacker portion 218. The printing controller 101 checks the timing when the recording medium 205 passes a not shown ejection sensor. When the recording medium 205 passes through the ejection sensor, the printing controller 101 stops applying the voltages to the charging rollers 12, the developing rollers 14*a* and the transfer rollers 212, and stops driving the respective motors. The above described printing operation is repeated for the subsequent recording media.

Next, the determination of the calculated surface temperature T of the heat roller 21 (FIG. 5) will be described.

As shown in FIG. 5, the heat roller 21 is heated by the halogen lamp 53. The non-contacting thermistor 54 is remote from the surface of the heat roller 21 (with a predetermined gap formed therebetween) and receives a radiant heat from the heat roller 21, and therefore the temperature of the non-contacting thermistor 54 changes. The non-contacting thermistor 54 detects the temperature thereof and sends the detected temperature T1 to the fixing controller 116 (FIG. 6).

Further, the upper cover 51 receives a radiant heat from the heat roller 21 so that the temperature of the upper cover 51 changes. The cover temperature detecting thermistor 60 (provided on the upper cover 51) detects the temperature of the upper cover 51 and sends the detected temperature T2 to the fixing controller 116.

Figure 7:
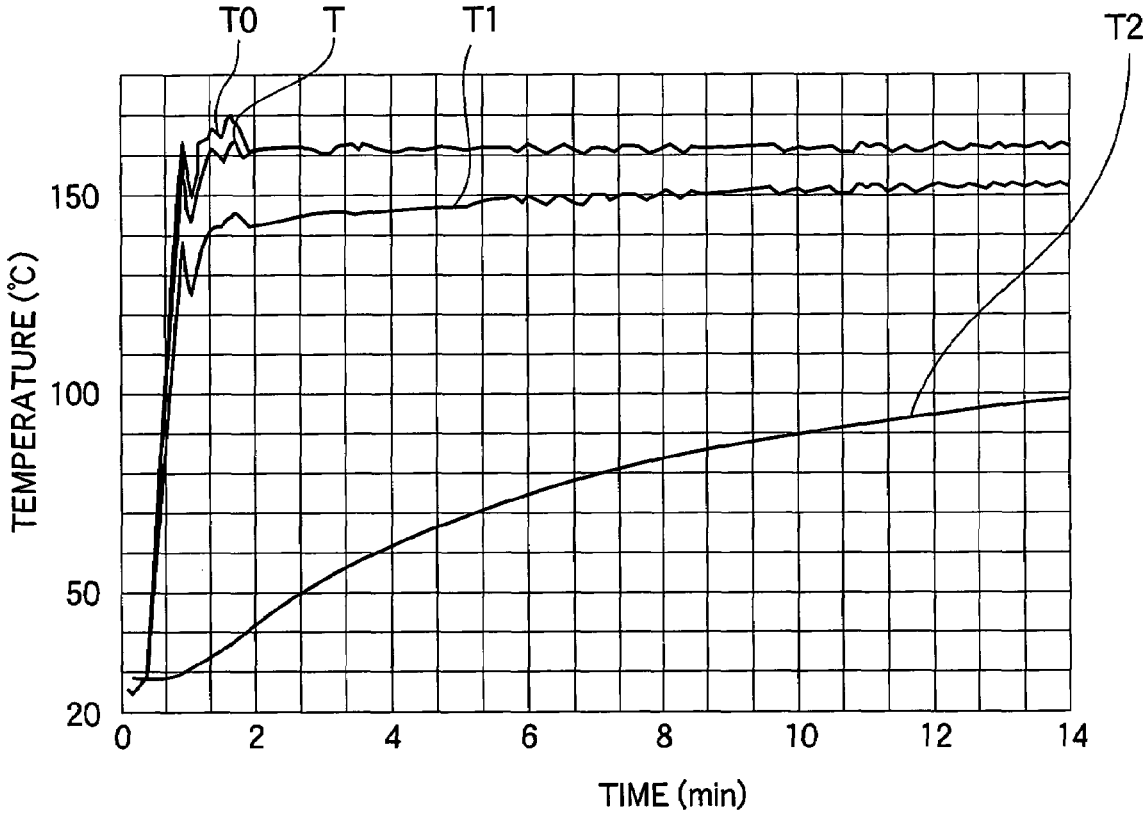
FIG. 7 is a graph illustrating changes with time of an actual surface temperature of the heat roller, a detected temperature detected by the non-contacting thermistor, and a detected temperature of the upper cover detected by a cover temperature detecting thermistor.

FIG. 7 is a graph illustrating the changes with time of the actual surface temperature T0 of the heat roller 21, the temperature T1 detected by the non-contacting thermistor 54, the temperature T2 of the upper cover 51 detected by the cover temperature detecting thermistor 60, when the heat roller 21 is heated by the halogen lamp 53 from the room temperature to 162° C. and is kept at 162° C.

When the heat roller 21 is heated by the halogen lamp 53 from the room temperature to 162° C., the printing operation is started as was described above. In this step, the detected temperature T1 detected by the non-contacting thermistor 54 is lower than the actual surface temperature T0 of the heat roller 21. The difference Td between the actual temperature T0 and the detected temperature T1 is the largest at an initial state where the temperature of the upper cover 51 (i.e., the detected temperature T2) is low. The difference Td decreases as the time elapses, i.e., as the temperature of the upper cover 51 (i.e., the detected temperature T2) increases.

Figure 8:
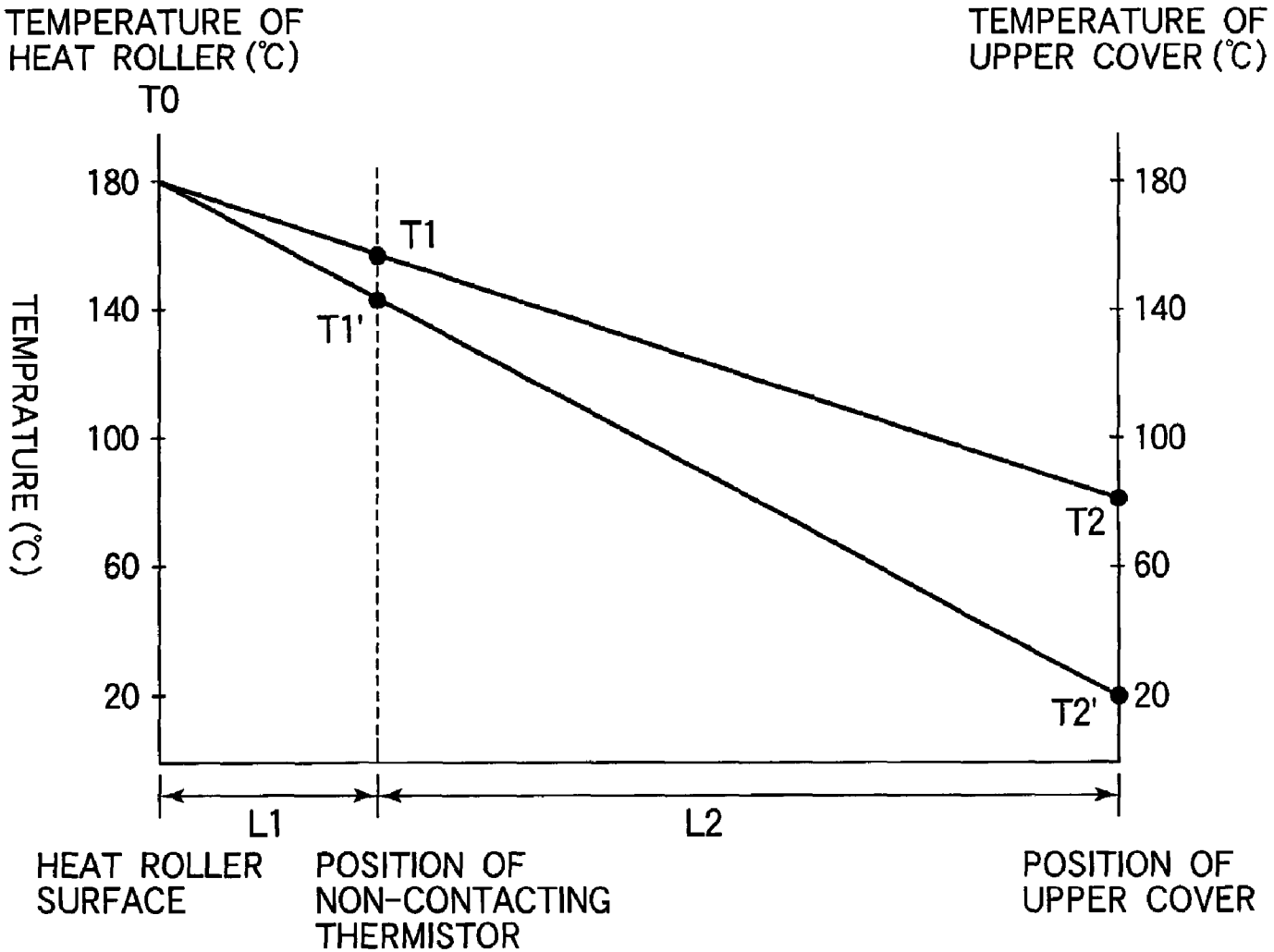
FIG. 8 illustrate the distribution of the temperature between the surface of the heat roller and a cover temperature detecting thermistor provided on the upper cover.

FIG. 8 illustrates the distribution of the temperature between the surface of the heat roller 21 and the cover temperature detecting thermistor 60 mounted on the upper cover 51.

As shown in FIG. 8, the distance from the surface of the heat roller 21 to the non-contacting thermistor 54 (disposed between the heat roller 21 and the cover temperature detecting thermistor 60 mounted on the upper cover 51) is indicated as L1. The distance from the upper cover 51 to the non-contacting thermistor 54 is indicated as L2. It is understood that the detected temperature detected by the non-contacting thermistor 54 increases as the position of the non-contacting thermistor 54 becomes closer to the surface of the heat roller 21. In the distribution of the temperature shown in FIG. 8, the highest temperature is the actual surface temperature T0 of the heat roller 21, and the lowest temperature is the temperature T2 of the upper cover 51.

In order to determine the actual surface temperature T0 of the heat roller 21, a calculated surface temperature T is determined by the following equation (1):

$$T=T1+(T1-T2)\times(L1/L2)\times C \quad (1)$$

where C indicates a constant, T1 indicates the detected temperature detected by the non-contacting thermistor 54, and T2 indicates the detected temperature of the upper cover 51 detected by the cover temperature detecting thermistor 60.

The calculated surface temperature T shown in FIG. 7 is determined by determining the constant C in the equation (1) so as to satisfy the following relationship:

$$(L1/L2)\times C=1/6$$

According to the experimental result of FIG. 7, it is understood that the calculated surface temperature T substantially coincides with the actual temperature T0 of the heat roller 21. In this experiment (FIG. 7), the distances L1 and L2 are respectively set to 1 mm and 8 mm, and the surface temperature of the heat roller 21 is within a range from 150° C. to 180° C.

As described above, it becomes possible to correctly calculate the actual surface temperature of the heat roller 21 based on the detected temperature T1 detected by the non-contacting thermistor 54 and the detected temperature T2 detected by the cover temperature detecting thermistor 60.

Figure 9:
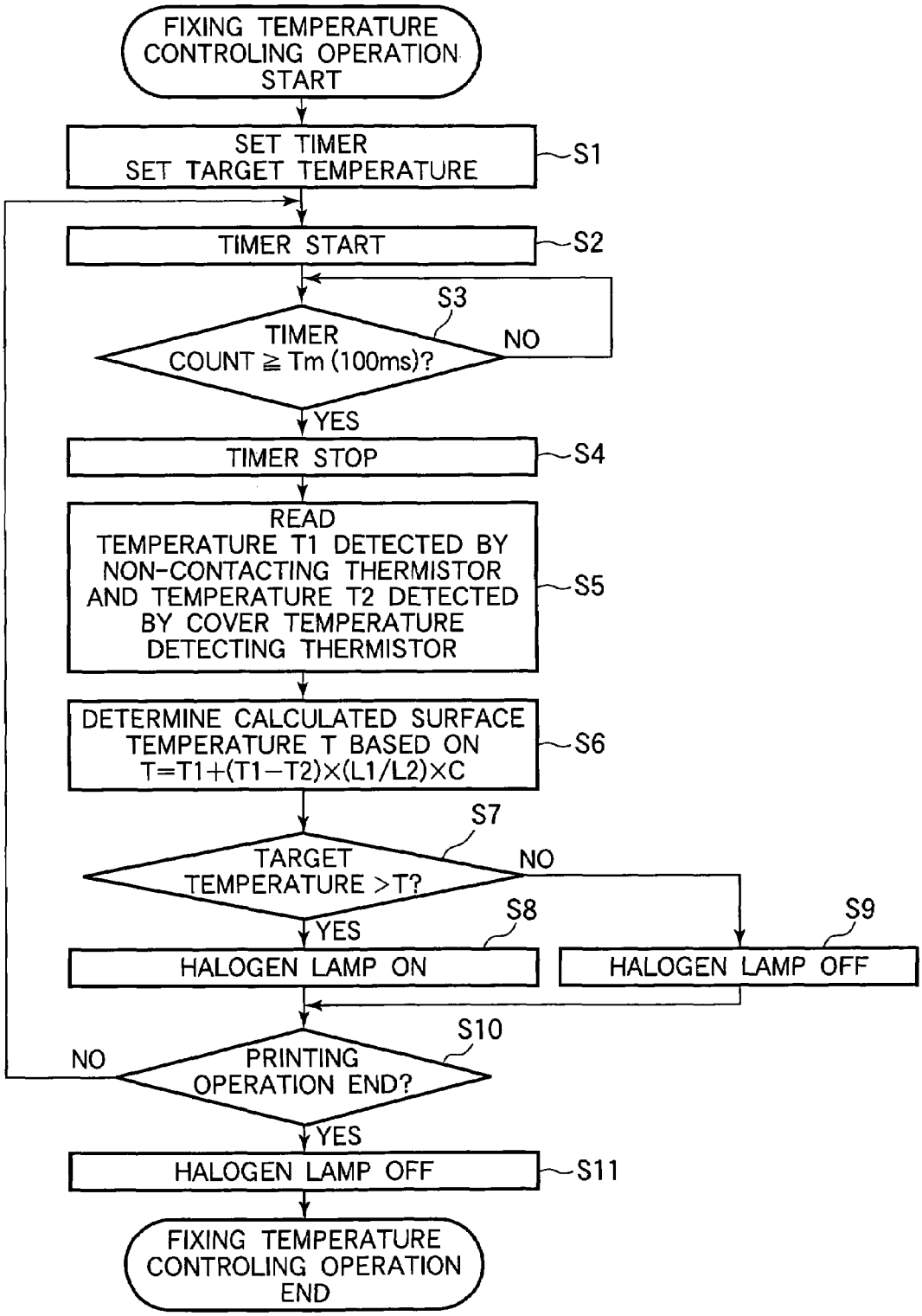
FIG. 9 is a flow chart illustrating the temperature controlling operation of the fixing device performed by a printing controller.

FIG. 9 is a flow chart illustrating the fixing temperature controlling operation of the fixing unit 213 performed by the printing controller 101 based on the calculated surface temperature T. The fixing temperature controlling operation of the fixing unit 213 will be described with reference to the flow chart of FIG. 9.

When the printing controller 101 (FIG. 6) receives a printing control command (i.e., a printing start command) from the superior device, the printing controller 101 starts the fixing temperature controlling operation of the fixing unit 213. First, the printing controller 101 sets the timer 116*a* of the fixing controller 116 to an operation time interval Tm of the temperature controlling. The printing controller 101 further determines the fixing temperature based on the kind of the recording medium and the printing condition (i.e., color printing or monochrome printing) and stores the determined fixing temperature as a fixing target temperature in the resistor 116*b* of the fixing controller 116 (step S1).

Next, the printing controller 101 starts the timer 116*a* (step S2). The printing controller 101 stops the timer 116*a* when the counted time reaches the predetermined operation time interval Tm (for example, 100 ms) (steps S3 and S4). The printing controller 101 reads the detected temperature T1 detected by the non-contacting thermistor 54 and the temperature T2 detected by the cover temperature detecting thermistor 60 (step S5). The printing controller 101 calculates the calculated surface temperature T corresponding to the actual surface temperature T0 of the heat roller 21 using the above described equation (1) based on the detected temperatures T1 and T2 (step S6).

The distances L1 and L2 (corresponding to the positions of the non-contacting thermistor 54 and the cover temperature detecting thermistor 60) and the constant C in the equation (1) are previously determined based on an experiment and stored in the memory of the printing controller 101. In this case, L1 is set to 1 mm, L2 is set to 8 mm, and C is set to 4/3.

Then, the printing controller 101 compares the calculated surface temperature T and the predetermined fixing target temperature (step S7). When the calculated surface temperature T is lower than the fixing target temperature, the printing controller 101 turns on the halogen lamp 53 (step S8). When the calculated surface temperature T is higher than or equals to the fixing target temperature, the printing controller 101 turns off the halogen lamp 53 (step S9). Next, the printing controller 101 determines whether the printing operation is to be continued or not (step S10). If the printing controller 101 determines that the printing operation is to be continued, the printing controller 101 repeats the processes of steps S2 through S9. If the printing controller 101 determines that the printing operation is to be ended, the printing controller 101 turns off the halogen lamp 53 (step S11), so that the fixing temperature controlling operation is ended. Although the starting of the printing operation has not been described in the above description of the fixing temperature controlling operation, the printing controller 101 starts the printing operation when the calculated temperature T reaches the fixing target temperature, and continues the printing operation performing the processes from step S2 to step S9 to maintain the fixing target temperature.

In Embodiment 1, the fixing unit 213, the fixing controller 116 and a part of the printing controller 101 associated with the controlling of the fixing unit 213 constitute the fixing device. Further, the fixing controller 116 and the part of the printing controller 101 associated with the controlling of the fixing unit 213 constitute a control unit that controls the heating of the halogen lamp 21 based on the detected temperatures T1 and T2.

As described above, according to the fixing device of Embodiment 1, it becomes possible to correctly calculated the actual surface temperature of the heat roller 21 based on the detected temperatures T1 and T2 detected by the non-contacting thermistor 54 and the cover temperature thermistor 60. Therefore, it becomes possible to correctly control the temperature of the heat roller 21, and to maintain the surface temperature of the heat roller 21 at the fixing target temperature.

Embodiment 2

Figure 10:
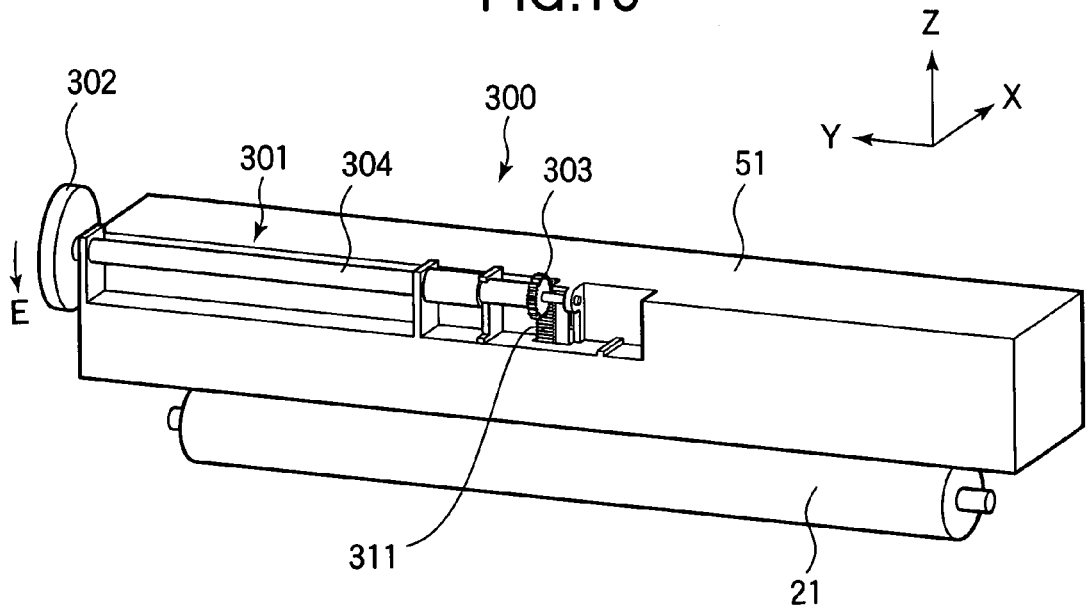
FIG. 10 is a top perspective view of an upper cover and a heat roller of a fixing device according to Embodiment 2 of the present invention.
Figure 11:
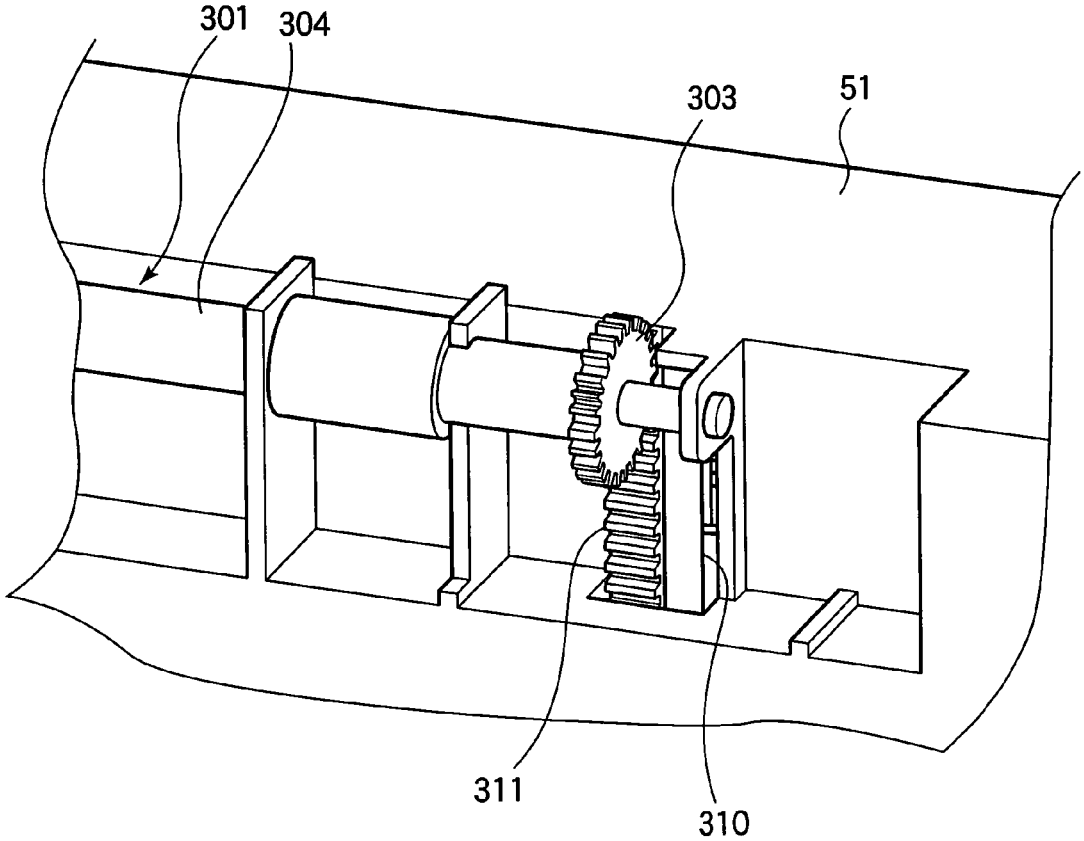
FIG. 11 is an enlarged view of an operation gear shown in FIG. 10 and parts around the operation gear.
Figure 12:
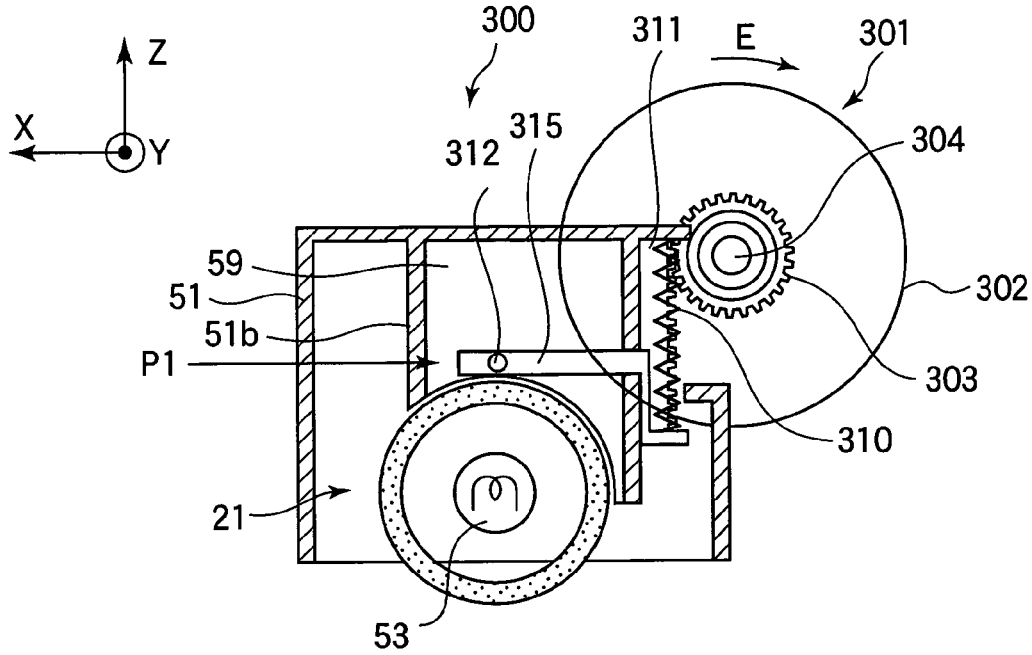
FIG. 12 is a sectional view of the main part of the fixing device shown in FIG. 10 as seen from plus side along Y-axis.
Figure 13:
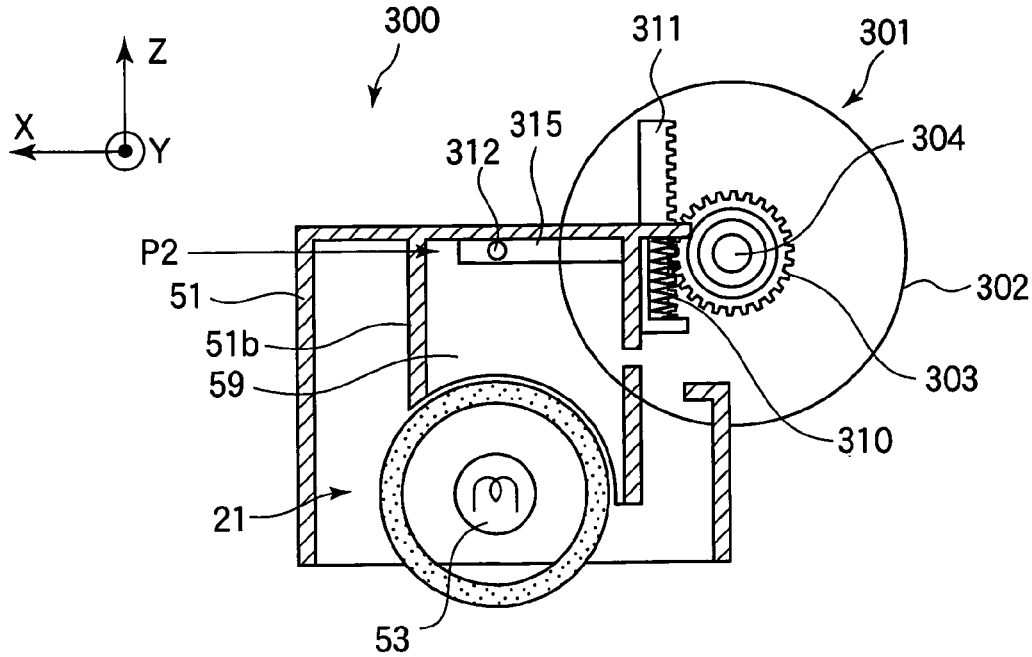
FIG. 13 is a sectional view of the main part of the fixing device shown in FIG. 10 as seen from plus side along Y-axis.

FIG. 10 is a perspective view of an upper cover 51 and a heat roller 21 of a fixing unit 300 according to Embodiment 2 of the present invention. FIG. 11 is an enlarged view of an operation gear 303 of the fixing unit 300 shown in FIG. 10 and parts around the operation gear 303. FIGS. 12 and 13 are cross sections of the main part of the fixing unit 300 in XZ-plane and seen from the positive side of Y-axis.

The fixing device having the fixing unit 300 of Embodiment 2 is mainly different from the fixing device having the fixing unit 213 of Embodiment 1 (FIG. 2) in that the fixing unit 300 has a thermistor (i.e., a common temperature detecting unit) 312 movable between a predetermined position P1 in the vicinity of the surface of the heat roller 21 (FIG. 12) and an upper cover temperature detecting position P2 (FIG. 13) in which the thermistor 312 contacts the upper cover 51. The thermistor 312 acts as the non-contacting thermistor 54 (FIG. 5) and the cover temperature detecting thermistor 60 (FIG. 5) of Embodiment 1. The thermistor 312 moves between the positions P1 and P2 at predetermined timings as described later.

The components of the fixing device having the fixing unit 300 of Embodiment 2 that are the same as those of the fixing device having the fixing unit 213 of Embodiment 1 (FIG. 2) are assigned the same reference numerals, and duplicate explanations are omitted. The emphasis of the description is on the difference between the fixing devices of Embodiments 1 and 2.

As shown in FIGS. 12 and 13, the upper cover 51 supports a sensor frame 315 that holds the thermistor 312 at the tip thereof. The upper cover 51 supports the sensor frame 315 so that the sensor frame 315 is slidable in the direction of Z-axis between the predetermined position P1 in the vicinity of the surface of the heat roller 21 (FIG. 12) and the upper cover temperature detecting position P2 (FIG. 13) in which the thermistor 312 contacts the upper cover 51. The sensor frame 315 is integrally formed with a rack gear 311 extending in the direction of Z-axis and disposed outside the upper cover 51. A compression spring 310 is provided between the sensor frame 315 and the upper cover 51. The compression spring 310 urges the sensor frame 315 in the negative direction along Z-axis in which the thermistor 312 approaches the heat roller 21.

A sliding drive mechanism 301 is provided on the outside of the upper cover 51 for driving the sensor frame 315 to slide. The sliding drive mechanism 301 includes a rotatable driving shaft 304, a transmission gear 302 fixed to one end of the driving shaft 304 for transmitting the rotation of a not-shown rotation drive motor, and an operation gear 303 fixed to the other end of the driving shaft 304. The operation gear 303 engages the rack gear 311 integrally formed with the sensor frame 315 (FIG. 12).

The operations of the respective parts of the fixing device constructed as above will be described.

When the driving shaft 304 is driven by the rotation drive motor (not shown) and rotates in the direction indicated by an arrow E, the rack gear 311 (engaging the operation gear 303) moves together with the sensor frame 315 upward away from the predetermined position P1 (FIG. 12) in which the thermistor 312 is in the vicinity of the surface of the heat roller 21, resisting the force of the compression spring 310. The rack gear 311, as well as the sensor frame 315, stops at the upper cover temperature detecting position P2 (FIG. 13) in which the thermistor 312 contacts the upper cover 51. When the rotation drive motor stops generating the driving force, the sensor frame 315 returns to the predetermined position P1 (FIG. 12) by the force of the spring 310. The sliding drive mechanism 301, the sensor frame 315, the rack gear 311 and the compression spring 310 constitute a moving mechanism.

In order to control the temperature of the fixing unit 300, the printing controller 101 (FIG. 6) performs the processes of the above described flow chart shown in FIG. 9. In the step S5 of the flow chart, the thermistor 312 detects the temperature T1 at the predetermined position P1 in the vicinity of the surface of the heat roller 21. Then, the rotation drive motor (not shown) starts rotating the driving shaft 304 in the direction indicated by the arrow E to thereby move the thermistor 312 to the upper cover temperature detecting position P2 in which the thermistor 312 contacts the upper cover 51. After the thermistor 312 detects the temperature T2 of the upper cover 51, the rotation drive motor stops generating the driving force, with the result that the thermistor 312 returns to the predetermined position P1.

The processes except the step S5 are the same as the steps of the flow chart described in Embodiment 1 (FIG. 9), and duplicate explanations are omitted.

As described above, according to the fixing device of Embodiment 2, the temperature of the heat roller 21 and the temperature of the upper cover 51 can be detected by a common single thermistor. Therefore, it becomes possible to provide a fixing device at a low price, in addition to the advantages described in Embodiment 1.

In Embodiments 1 and 2, the temperature of the upper cover 51 is detected in order to correctly evaluate the surrounding temperature of the non-contacting thermistor 54. However, Embodiments 1 and 2 are not limited to this arrangement. As long as the surrounding temperature of the non-contacting thermistor 54 is detected, it is possible to detect the temperature of other portion in the fixing device.

Embodiment 3

Figure 14:
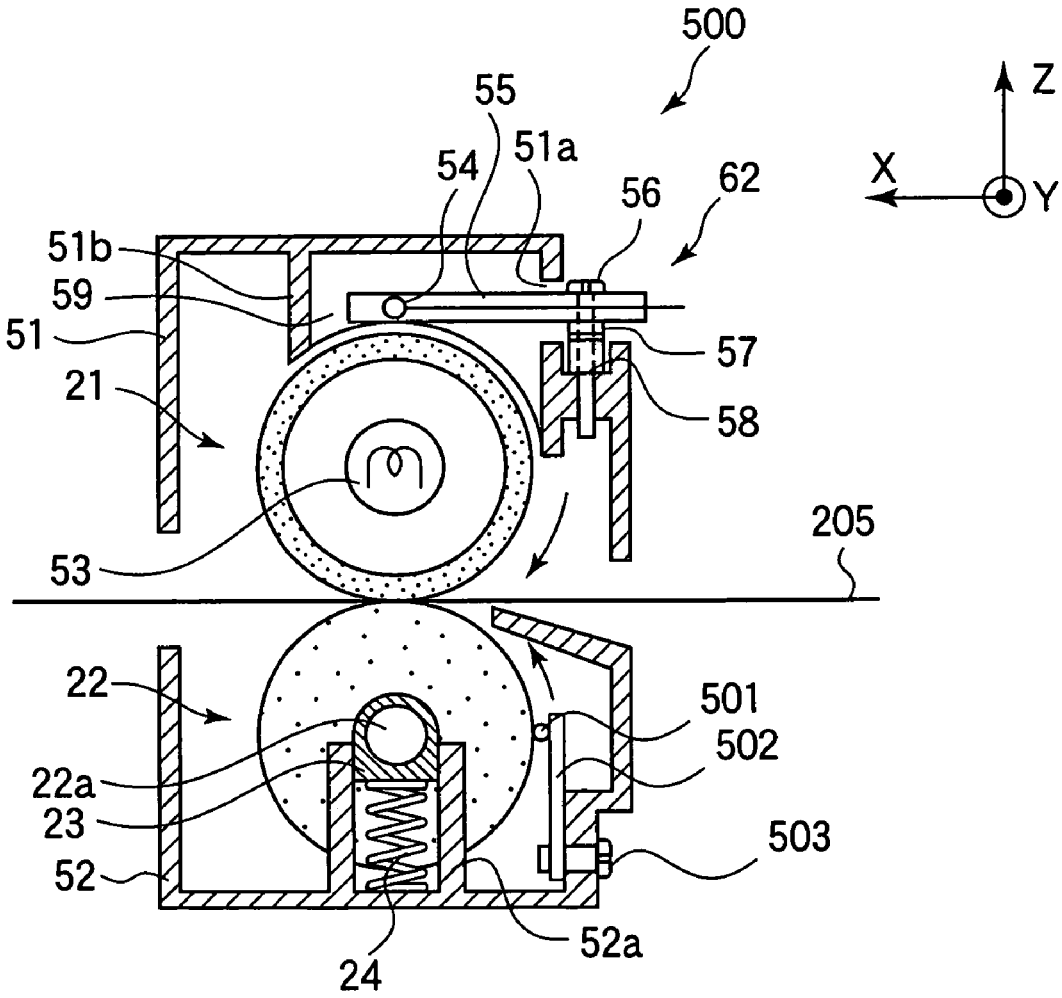
FIG. 14 is a sectional view of a fixing device of Embodiment 3.

FIG. 14 is a sectional view of a fixing device having a fixing unit 500 according to Embodiment 3 of the present invention. FIG. 14 corresponds to a cross section of the fixing device cut by a plane indicated by a line V-V in FIG. 2.

The fixing unit 500 is different from the fixing unit 213 (FIG. 5) of Embodiment 1 in that the fixing unit 500 has no cover temperature detecting thermistor 60 (FIG. 5) but has a contacting-type thermistor (i.e., a third temperature detecting unit) 501 that contacts the surface of the pressure roller 22 to detect the surface temperature of the pressure roller 22. The components of the fixing unit 500 that are the same as those of the fixing unit 213 of Embodiment 1 are assigned the same numerals, and duplicate explanations are omitted. The emphasis of the description is on the difference between the fixing unit 500 and the fixing unit 213.

As shown in FIG. 14, the contacting-type thermistor 501 is mounted on a tip of a sensor supporting arm 502 fixed to the lower cover 52 of the fixing unit 500 by means of a fixing screw 503. The contacting-type thermistor 501 contacts the surface of the pressure roller 22 so that a predetermined pressure is maintained therebetween.

Figure 15:
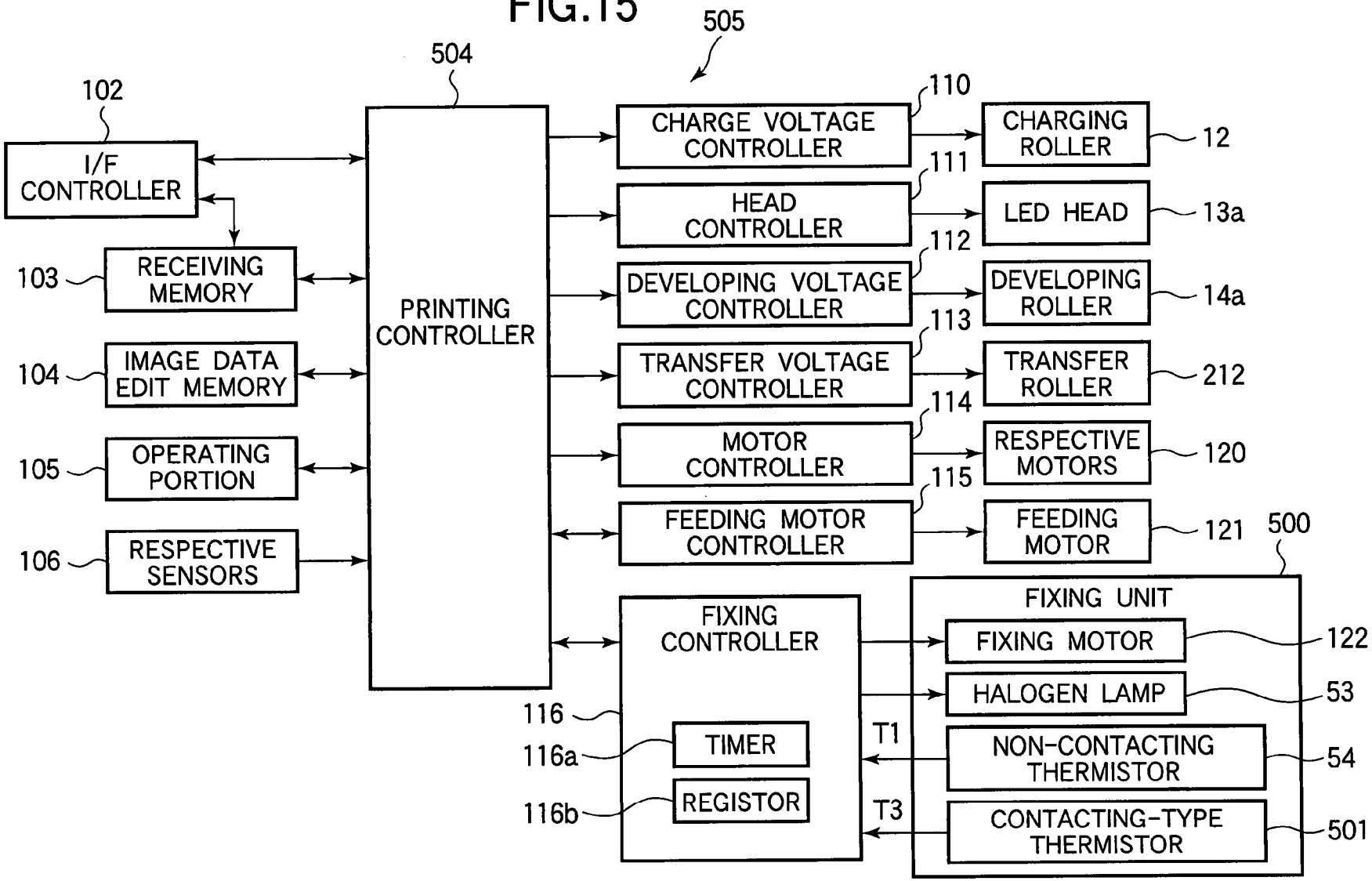
FIG. 15 is a block diagram illustrating a control system of an image forming portion of an image forming apparatus employing a fixing device of Embodiment 3.

FIG. 15 is a block diagram of a control system of an image forming portion 505 of an image forming apparatus having the fixing unit 500 of Embodiment 3. The image forming apparatus of Embodiment 3 (having the fixing unit 500) is different from the image forming apparatus (FIG. 1) of Embodiment 1 in that the image forming apparatus of Embodiment 3 has the fixing unit 500 instead of the fixing unit 213 and has the image forming portion 505 instead of the image forming portion 100 (FIG. 6). Therefore, in the description of the image forming apparatus of Embodiment 3, the image forming apparatus 100 shown in FIG. 1 will be referred to.

The image forming portion 505 (FIG. 15) is different from the image forming portion 100 shown in FIG. 6 in that the fixing unit 500 of the image forming portion 505 has a contacting-type thermistor 501 (that contacts the surface of the pressure roller 22 and detects the temperature thereof) instead of the upper cover temperature detecting thermistor 60 (FIG. 6). Further, the signal processing method performed by the printing controller 504 of the image forming portion 505 (FIG. 15) is different from that of the image forming portion 100 shown in FIG. 6. Therefore, the components of the image forming portion 505 that are the same as those of the image forming portion 100 are assigned the same reference numerals, and the duplicate explanations are omitted. Emphasis of the description is on the difference between the image forming portions 100 and 505.

The fixing controller 116 controls the fixing unit 500 (FIG. 14) for fixing the toner image to the recording medium 205 (FIG. 1). In particular, the fixing controller 116 controls the voltage applied to the halogen lamp 53 provided in the heat roller 21, in response to the instruction from the printing controller 504. The fixing controller 116 receives the detected temperature T1 from the non-contacting thermistor 54 for measuring the surface temperature of the heat roller 21 and the detected temperature T3 from the contacting-type thermistor 501 for measuring the surface temperature of the pressure roller 22, and controls the halogen lamp 53 by turning on and off the halogen lamp 53 based on the detected temperatures T1 and T3.

Next, the calculating method of the calculated surface temperature T of the heat roller 21 (FIG. 14) will be, described.

Figure 16:
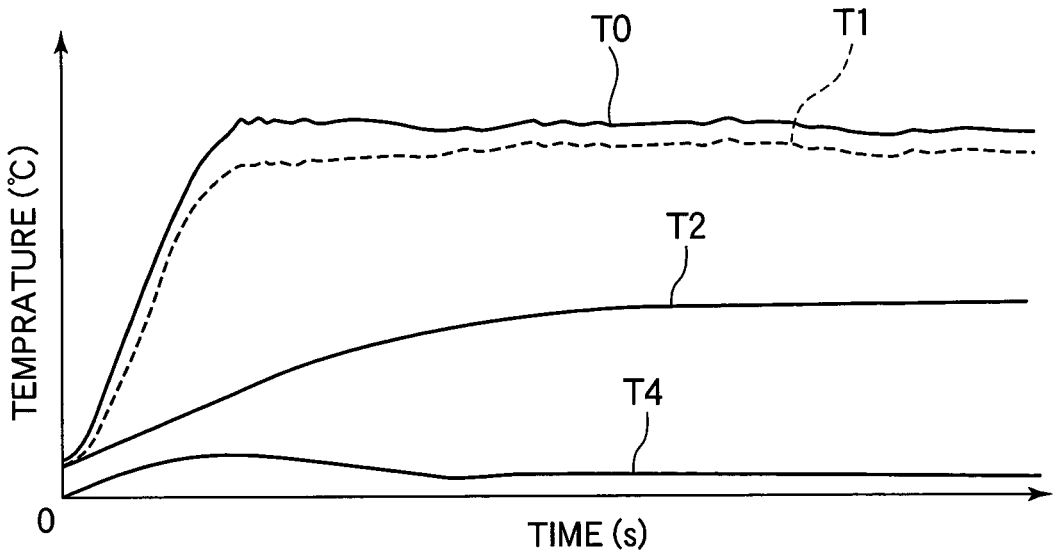
FIG. 16 is a graph illustrating changes with time of an actual surface temperature of a heat roller, a detected temperature detected by a non-contacting thermistor, and a surrounding temperature of the non-contacting thermistor, in a state where the heat roller is heated from a room temperature to a predetermined temperature and is kept in a warm operating condition in Embodiment 3.

FIG. 16 is a graph illustrating changes with time of the actual surface temperature T0 of the heat roller 21, the detected temperature T1 detected by the non-contacting thermistor 54, and the surrounding temperature T2 of the non-contacting thermistor 54 (for example, the ambient temperature in the fixing unit, the temperature of the cover of the fixing unit), in a state where the heat roller 21 is heated from a room temperature to a predetermined temperature and is kept in a warm operating condition.

As shown in FIG. 16, if the detected temperature T1 detected by the non-contacting thermistor 54 is compared with the actual surface temperature T0 of the heat roller 21 detected by an experimentally provided contacting-type thermistor (not shown), the detected temperature T1 detected by the non-contacting thermistor 54 is lower than the actual surface temperature T0. This is because the non-contacting thermistor 54 is remote from the surface of the heat roller 21. The difference between the detected temperature T1 and the actual surface temperature T0 increases as a gap between the heat roller 21 and the non-contacting thermistor 54 increases, but is theoretically zero if the gap is zero.

However, even when there is a gap between the heat roller 21 and the non-contacting thermistor 54, the difference T4(=T0−T1) between the temperatures T0 and T1 is not constant. It is found by the experiment that, with the increase of the surrounding temperature T2 of the non-contacting thermistor 54 detected by an experimentally provided thermistor (for example, the cover temperature detecting thermistor 60 of FIG. 5, in Embodiment 1), the difference T4 initially increases, then gradually decreases, and finally becomes constant as the surrounding temperature T2 becomes saturated. The experimental result slightly deviates according to whether the heat roller 21 is rotating or not, and whether the recording medium is passing through the heat roller 21 and the pressure roller 22 or not, but the slight deviation does not affect the fixing performance.

It is understood that, in a transition state from the cold operating condition to the warm operating condition (in which the temperature T2 is saturated), the difference T4 between the actual surface temperature T0 of the heat roller 21 and the detected temperature T1 detected by the non-contacting thermistor 54 changes because the surrounding air of the non-contacting thermistor 54 is gradually heated and the radiant heat from the surrounding cover gradually increases. In the warm operating condition, the difference T4 becomes substantially constant because the temperature of the surrounding air of the non-contacting thermistor 54 and the radiant heat from the surrounding cover become substantially constant.

In the above described Embodiments 1 and 2, the actual temperature T0 of the heat roller 21 is calculated based on the detected temperature of the upper cover 51 representing the surrounding temperature T2. In Embodiment 3, the actual temperature T0 of the heat roller 21 is calculated based on the detected temperature T3 of the pressure roller 22 detected by the contacting-type thermistor 501 that contacts the pressure roller 22. The calculation of the actual temperature T0 will be described.

Figure 17:
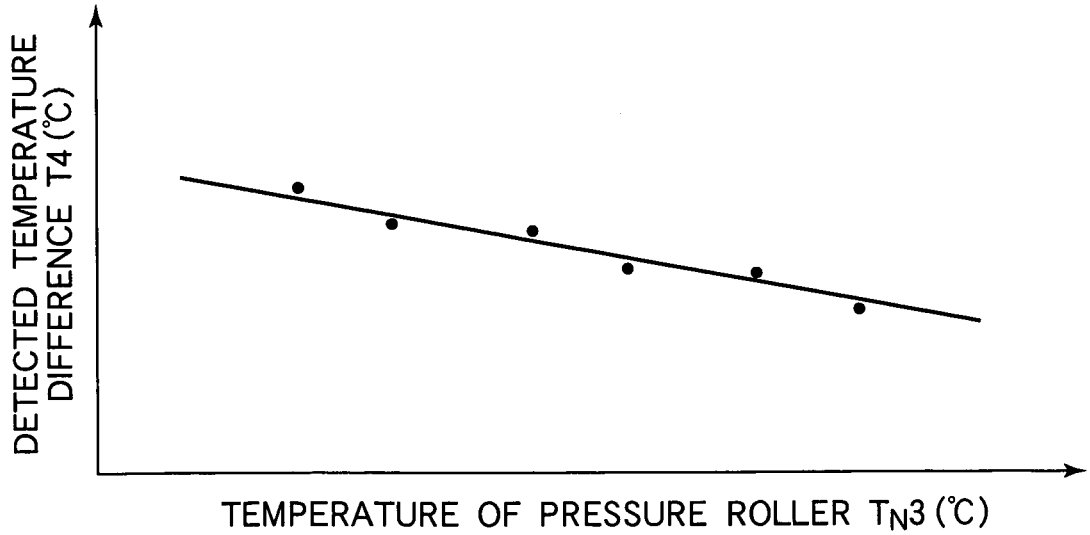
FIG. 17 is a graph illustrating the experimentally obtained relationship between the temperature of the pressure roller and the detected temperature difference, when N seconds have elapsed after the heat roller is heated to the predetermined temperature and starts to rotate in Embodiment 3.

FIG. 17 is a graph illustrating the relationship (obtained by an experiment) between the detected temperature $T_N$3 of the pressure roller 22 and the above described difference T4(=T0−T1) when N seconds (sufficient for the pressure roller 22 to be uniformly heated) have elapsed after the heat roller 21 is heated to the predetermined temperature and starts rotating. According to the experimental result shown in FIG. 17, the relationship between the detected temperature $T_N$3 of the pressure roller 22 and the calculated temperature difference T4' is expressed as the following linear equation (2):

$$T4'(^\circ\,\mathrm{C.})=a\times T_N3(^\circ\,\mathrm{C.})+b \qquad (2)$$

In the equation (2), a and b are constants. T4' indicates the temperature difference determined by the calculation and is distinguished from the actual temperature difference T4.

The equation (2) indicates that there is a close relationship between the increase in temperature of the interior of the fixing device and the increase in temperature of the surface of the pressure roller 22 immediately after the printing operation is started and the fixing motor 122 (FIG. 15) starts rotating, because the pressure roller 22 has no heat source. Further, the equation (2) indicates that the detected temperature $T_n$3 of the pressure roller 22 when N seconds have passed after the heat roller 21 starts rotating can be used as an alternative value representing the surrounding temperature T2.

The detected temperature T1 detected by the non-contacting thermistor 54 and the actual surface temperature T0 of the heat roller 21 are expressed as follows.

$$T0(^\circ\,\mathrm{C.})=T1(^\circ\,\mathrm{C.})+T4(^\circ\,\mathrm{C.})$$

In order to obtain the actual surface temperature T0, the calculated surface temperature T is determined according to the following equation (3).

$$T(^\circ\text{ C.}) = T1(^\circ\text{ C.}) + T4'(^\circ\text{ C.}) \quad (3)$$
$$= T1(^\circ\text{ C.}) + a \times T_N3(^\circ\text{ C.}) + b$$

According to the equation (3), it is possible to correctly calculate the actual surface temperature of the heat roller 21 based on the detected temperature T1 detected by the non-contacting thermistor 54 and the temperature $T_N$3 of the pressure roller 22 detected by the contacting-type thermistor 501, particularly even when the fixing unit 500 shifts from the cold operating condition to the warm operating condition.

Figure 18:
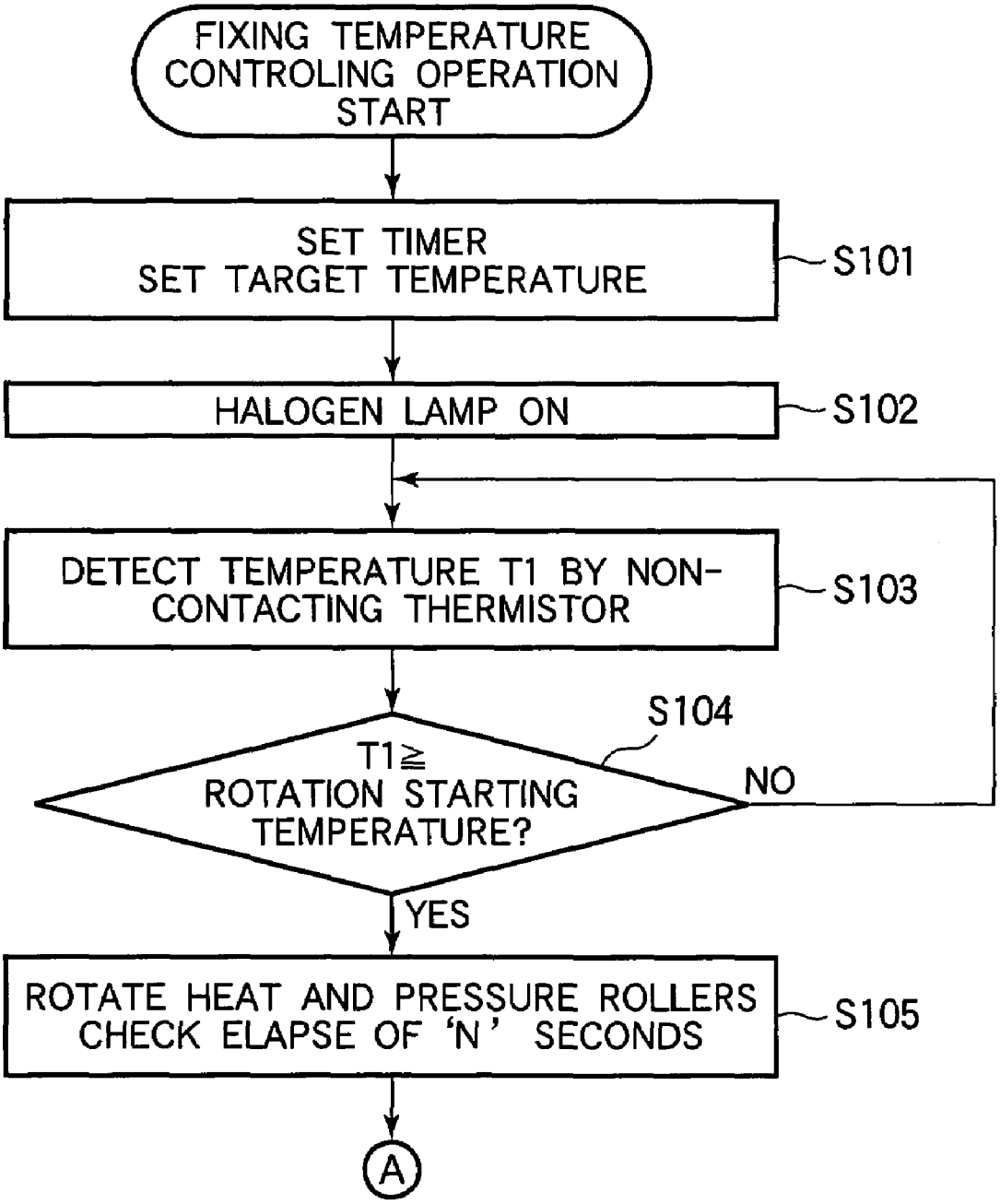
FIG. 18 is a flow chart illustrating the temperature controlling operation of the fixing device performed by a printing controller based on a calculated surface temperature T in Embodiment 3.
Figure 19:
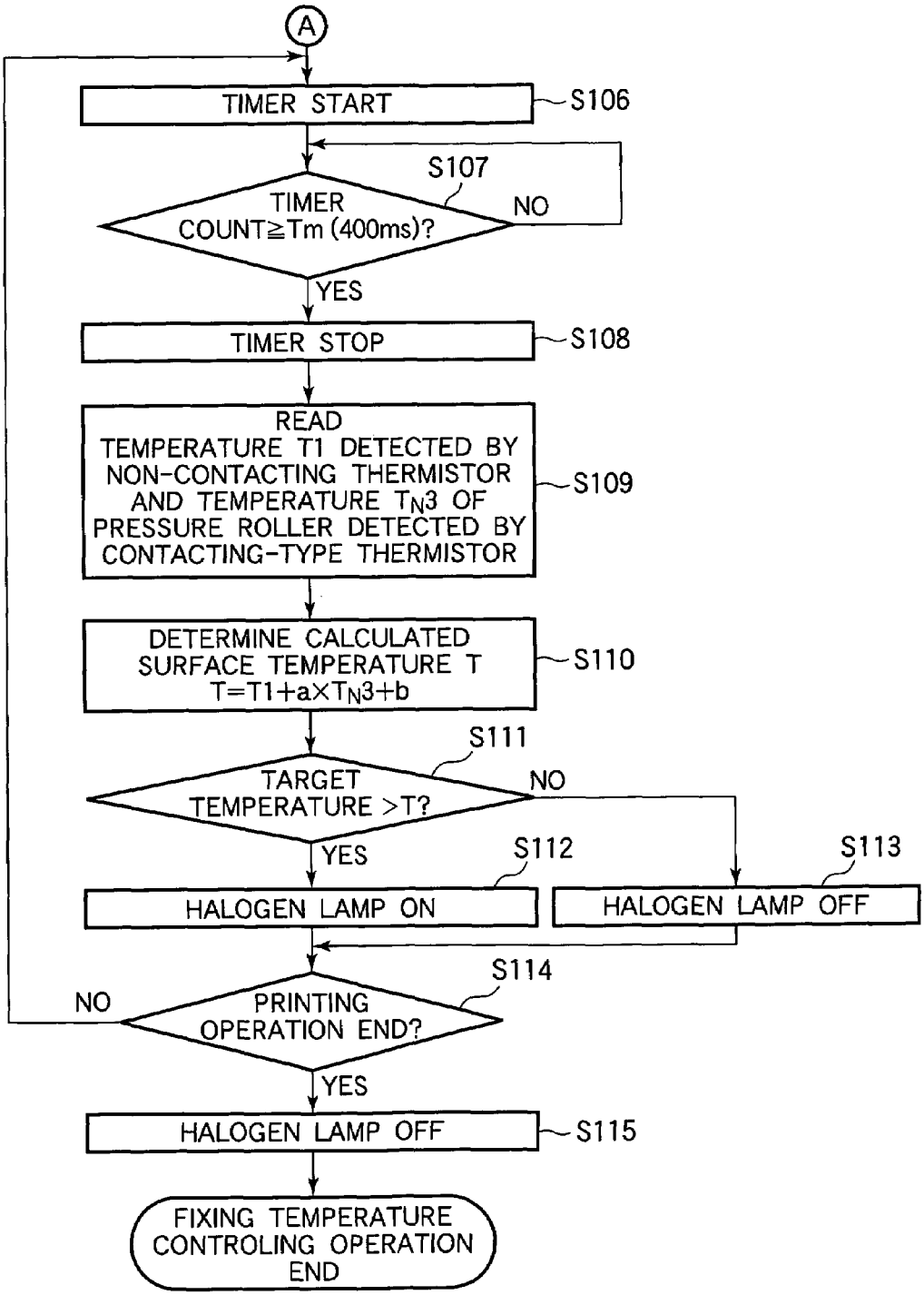
FIG. 19 is a flow chart illustrating the temperature controlling operation of the fixing device performed by a printing controller based on a calculated surface temperature T in Embodiment 3.

FIGS. 18 and 19 are flow charts illustrating the temperature controlling operation of the fixing unit 500 performed by the printing controller 504 (FIG. 15) according to the calculated surface temperature T. The temperature controlling operation of the fixing unit 500 will be described with reference to FIGS. 18 and 19.

When the printing controller 504 (FIG. 15) receives the printing control command (i.e., printing start command) from the superior device, the printing controller 504 starts the fixing temperature controlling operation. First, the printing controller 504 sets the timer 116*a* in the fixing controller 116 to the operation time interval Tm (for example, 400 ms) of the temperature controlling. The printing controller 504 further determines the fixing temperature based on the kind of the recording medium (for example, a thick paper, a thin paper or an OHP sheet) and the printing condition (for example, a color printing or a monochrome printing) and set the fixing temperature as a fixing target temperature. The printing controller 101 stores the fixing target temperature in the resistor 116*b* in the fixing controller 116 (step S101).

Next, the printing controller 504 turns on the halogen lamp 53 to heat the heat roller 21 (step S102). Then, the printing controller 504 reads the detected temperature T1 detected by the non-contacting thermistor 54. The printing controller 504 repeats the reading of the detected temperature T1 detected by the non-contacting thermistor 54 until the detected temperature T1 reaches the predetermined rotation starting temperature (steps S103 and S104). The rotation starting temperature has previously been set in consideration of an error in the detected temperature T1 so as to ensure that the heat roller 21 starts rotating after the toner on the heat roller 21 has molten. When the detected temperature T1 reaches the rotation starting temperature, the printing controller 504 starts driving the fixing motor 122 so that the heat roller 21 and the pressure roller 22 rotate as indicated by arrows, and checks whether N seconds (sufficient for the pressure roller 22 to be uniformly heated) has elapsed or not (step S105).

Then, the printing controller 504 starts the timer 116*a* (step S106). The printing controller 504 stops the timer 116*a* when the counted time reaches the predetermined operation time interval Tm (for example, 400 ms) (steps S107 and S108). The printing controller 504 reads the detected temperature T1 detected by the non-contacting thermistor 54 and the temperature $T_N$3 detected by the contacting-type thermistor 501 (step S109). The printing controller 504 calculates the calculated surface temperature T corresponding to the actual surface temperature T0 of the heat roller 2 using the above described equation (3) based on the detected temperatures T1 and $T_N$3 (step S110). In the equation (3), a and b are constants having been previously determined by experiment.

Then, the printing controller 504 compares the calculated surface temperature T and the predetermined fixing target temperature (step S111). When the calculated surface temperature T is lower than the fixing target temperature, the printing controller 504 turns on the halogen lamp 53 (step S112). When the calculated surface temperature T is higher than or equals to the fixing target temperature, the printing controller 504 turns off the halogen lamp 53 (step S113). Next, the printing controller 504 determines whether the printing operation is to be continued or not (step S114). If the printing controller 504 determines that the printing operation is to be continued, the printing controller 504 repeats the processes of steps S106 through S114. If the printing controller 504 determines that the printing operation is to be ended, the printing controller 504 turns off the halogen lamp 53 and stops the fixing motor 122 (step S115), so that the fixing temperature controlling operation is ended. In the step S114, whether the printing operation is to be ended or not is determined based on whether the trailing end of the recording medium 205 is detected by a not-shown sensor and whether there is a subsequent printing data.

In Embodiment 3, the fixing unit 500, the fixing controller 116 and a part of the printing controller 504 associated with the controlling of the fixing unit 500 constitute the fixing device. The fixing controller 116 and a part of the printing controller 504 associated with the controlling of the fixing unit 500 constitute a control unit that controls the heating of the halogen lamp based on the detected temperatures T1 and T3.

As described above, according to the fixing device of Embodiment 3, the calculated surface temperature T of the heat roller 21 can be obtained by compensating the detected temperature T1 of the heat roller 21 (detected by the non-contacting thermistor 54) using the detected temperature $T_N$3 when the N seconds (sufficient for the pressure roller 22 to be uniformly heated) have elapsed after the printing operation is started and the heat roller 21 and the pressure roller 22 start rotating. In this case, it is not necessary to provide an additional temperature detecting means for detecting the surrounding temperature T2 (for example, the temperature in the fixing unit and the temperature of the cover of the fixing unit) of the non-contacting thermistor 54.

Embodiment 4

The fixing device of Embodiment 4 is different from the fixing device of Embodiment 3 in the signal processing method performed by the printing controller 504. Therefore, in the description of the signal processing method of the fixing device of Embodiment 4, FIG. 14 (i.e., the sectional view of the fixing unit 500) and FIG. 15 (i.e., the block diagram of the control system of the image forming portion 505) are referred to. Duplicated explanations are omitted, and the emphasis of the description is on the difference between the fixing devices of Embodiments 3 and 4. Although the signal processing method of the printing controller of Embodiment 4 is different from that of the printing controller 504 of Embodiment 3, the printing controller of Embodiment 4 is denoted by reference numeral 54 for convenience.

A method for determining the calculated surface temperature T of the heat roller 21 (FIG. 6) according to Embodiment 4 will be described.

Figure 20:
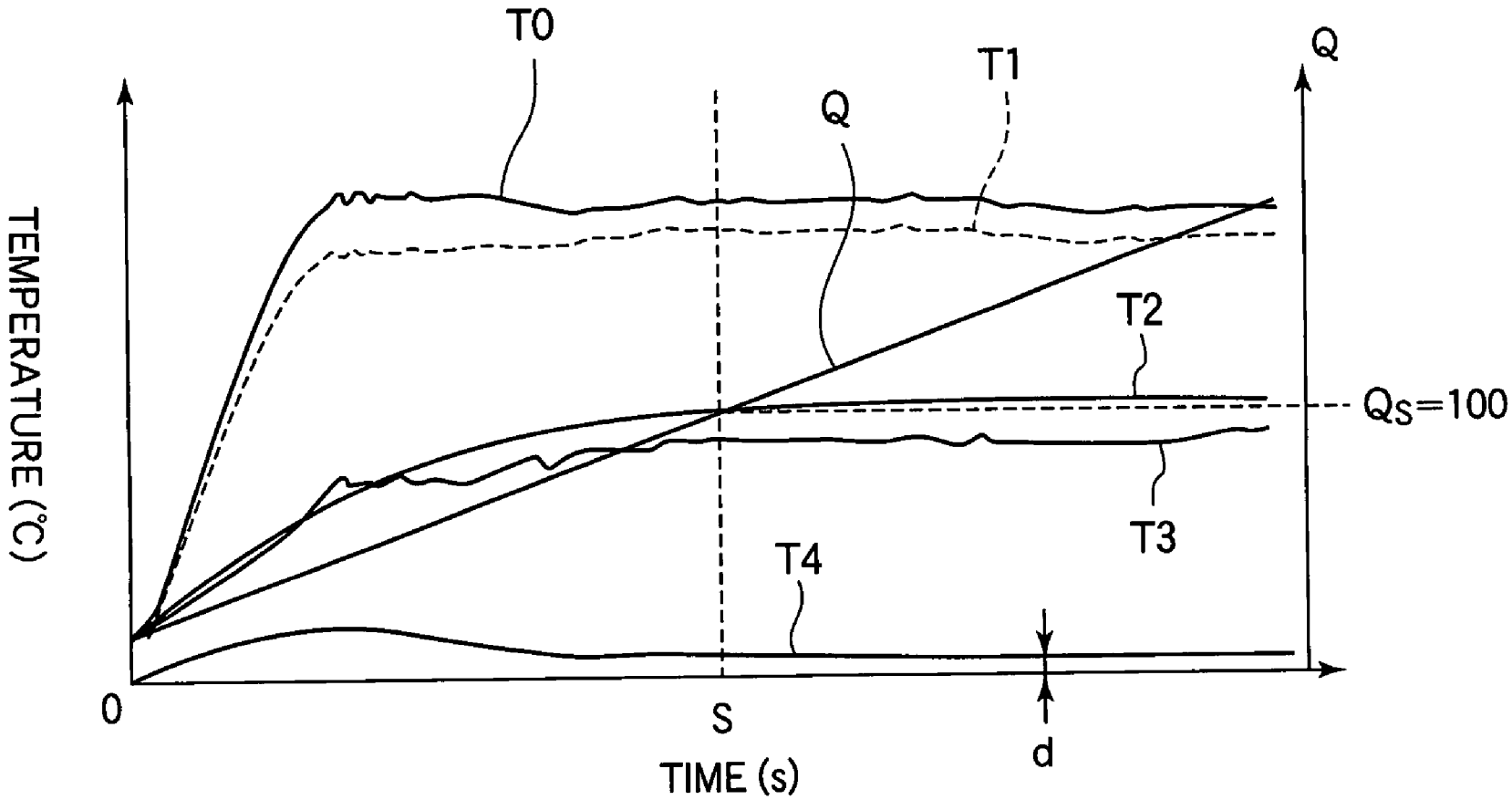
FIG. 20 is a graph illustrating changes with time of an actual surface temperature of a heat roller, a detected temperature detected by a non-contacting thermistor, and a surrounding temperature of the non-contacting thermistor, a detected temperature of the pressure roller and an accumulated roller temperature index, in a state where the heat roller is heated from a room temperature to a predetermined temperature and is kept in a warm operating condition in Embodiment 4.

FIG. 20 is a graph illustrating the changes with time of the actual temperature T0 of the heat roller 21, the detected temperature T1 detected by the non-contacting thermistor 54, the surrounding temperature T2 (for example, the temperature in the fixing unit and the temperature of the cover of the fixing unit) of the non-contacting thermistor 54, and the detected temperature T3 of the pressure roller 22 detected by the contacting-type thermistor 501, in a state where the heat roller 21 is heated by the halogen lamp 53 from the room temperature (i.e., the cold operating condition) to the warm operating condition in which the surrounding temperature T2 is saturated at the predetermined temperature and is kept at the warm operating condition.

In FIG. 20, the actual temperature T0 is determined by an experimentally provided contacting thermistor (not shown). If the detected temperature T1 detected by the non-contacting thermistor 54 is compared with the actual temperature T0, the detected temperature T1 is lower than the actual temperature T0 because the non-contacting thermistor 54 is remote from the surface of the heat roller 21. The difference between the temperatures T0 and T1 increases, as the gap between the surface of the heat roller 21 and the non-contacting thermistor 54 increases. Theoretically, there is no difference between the temperatures T0 and T1 when the gap between the surface of the heat roller 21 and the non-contacting thermistor 54 is zero. The temperature difference T4 shown in FIG. 20 is determined by the relationship T4=T0−T1 as was described above.

An accumulated roller temperature index Q indicates the accumulated amount of the detected temperature T1 detected by the non-contacting thermistor 54 and the accumulated amount of the detected temperature T3 of the pressure roller 22, after the halogen lamp 53 is turned on. The accumulated roller temperature index Q is expressed by the following equation (4).

$$Q=\{c\times T1(\text{start})+\tau\times T3(\text{start})\}+\int\{\kappa(T1+T3)\}dt \quad (4)$$

In equation (4), T1 (start) indicates the temperature (° C.) detected by the non-contacting thermistor 54 immediately after the halogen lamp 53 is turned on. T2 (start) indicates the detected temperature (° C.) of the pressure roller 22 detected by the contacting-type thermistor 501 immediately after the halogen lamp 53 is turned on. Further, c, τ and κ are constants.

As the characteristics of the accumulated roller temperature index Q, the experiment teaches that the time S when the accumulated roller temperature index Q is equal to a predetermined value Qs (for example, Qs=100 when c=τ=0.5 and κ=5000) approximately coincides with the time when the surrounding temperature T2 of the non-contacting thermistor 54 is saturated as shown in FIG. 20.

Based on the experiment result, it is understood that the increase in the surrounding temperature T2 (for example, the temperature of the fixing unit cover or the interior of the fixing frame) is closely analogous to the accumulated temperatures of the heat roller 21 and the pressure roller 22 in the following processes of:

(1) a heat inputting process in which the halogen lamp 53 generates heat, (2) a heat transmitting process in which the heat is transmitted to the heat roller 21 and the pressure roller 22 and causes the surrounding temperature (for example, the temperature of the fixing unit cover or the interior of the fixing unit) to increase via heat transmission or heat radiation, and (3) a heat outputting process in which the recording medium 205 draws the heat from the heat roller 21 and the pressure roller 22 or a cooling fan draws the heat from the fixing unit 500.

In the example of the experiment shown in FIG. 20, the value of the accumulated roller temperature index Q is determined on condition that the halogen lamp 53 is turned on when the fixing unit 500 is in the cold operating condition (i.e., at the room temperature). Thus, if the detected temperature T1 (start) detected by the non-contacting thermistor 54 is 25° C. and the detected temperature T3 (start) of the pressure roller 22 is 25° C. when the halogen lamp 53 is turned on, the initial value of the accumulated roller temperature index Q is (25+25)/2=25, and is less than Qs(=100). When the accumulated roller temperature index Q is less than the predetermined value Qs, the calculated surface temperature T is compensated by the equation (3) described in Embodiment 3.

$$T(°\text{ C.})=T1(°\text{ C.})+a\times T_N3(°\text{ C.})+b \quad (3)$$

This compensation is referred to as a cold operating temperature compensation.

In contrast, in the case where the halogen lamp 53 is turned on when the fixing unit 500 is in the warm operating condition, for example, when the detecting temperature T1 (start) detected by the non-contacting thermistor 54 is 180° C. and the detected temperature T3 (start) is 100° C., the initial value of the accumulated roller temperature index Q is (180+100)/2=140, and is greater than Qs(=100). When the accumulated roller temperature index Q is greater than or equals to the predetermined value Qs, a warm operating temperature compensation is performed as follows.

In performing the warm operating temperature compensation, there is the following relationship between the detected temperature T1 detected by the non-contacting thermistor 54 and the actual surface temperature T0:

$$T0(°\text{ C.})=T1(°\text{ C.})+T4(°\text{ C.})$$

As shown in FIG. 20, in the warm operating condition after the time S has elapsed and the surrounding temperature of the non-contacting thermistor 54 is saturated, the detected temperature difference T4 becomes substantially constant value which is referred to as a compensation coefficient d. Therefore, in the warm operating temperature compensation, in order to determine the actual surface temperature T0 by calculation, the calculated surface temperature T is determined by the following equation:

$$T0(°\text{ C.})=T1(°\text{ C.})+d(°\text{ C.}) \quad (5)$$

where d is a constant that has been experimentally determined.

As described above, in Embodiment 4, the accumulated roller temperature index Q is first determined. Based on the accumulated roller temperature index Q, it is determined whether the fixing unit 500 is in the warm operating condition (in which the surrounding temperature T2 is saturated and stabilized) or the cold operating condition (in which the warm operating condition has not been reached). The calculated surface temperature is obtained by the equation suitable for the operating condition (i.e., the warm operating condition or the cold operating condition).

The compensation of the detected temperature when the halogen lamp 53 is turned on is performed as was described above. In a series of processes performed by the image forming apparatus, if the printing operation is not performed for a predetermined period, the image forming apparatus shifts to a standby condition. In this case, when the next printing operating is started, the detected temperature T1 detected by the non-contacting thermistor 54 and the detected temperature T3 of the pressure roller 22 are read respectively as T1 (start) and T3 (start). Based on the detected temperatures T1 (start) and T3 (start), it is determined whether the warm operating temperature compensation or the cold operating temperature compensation is to be started.

Figure 21:
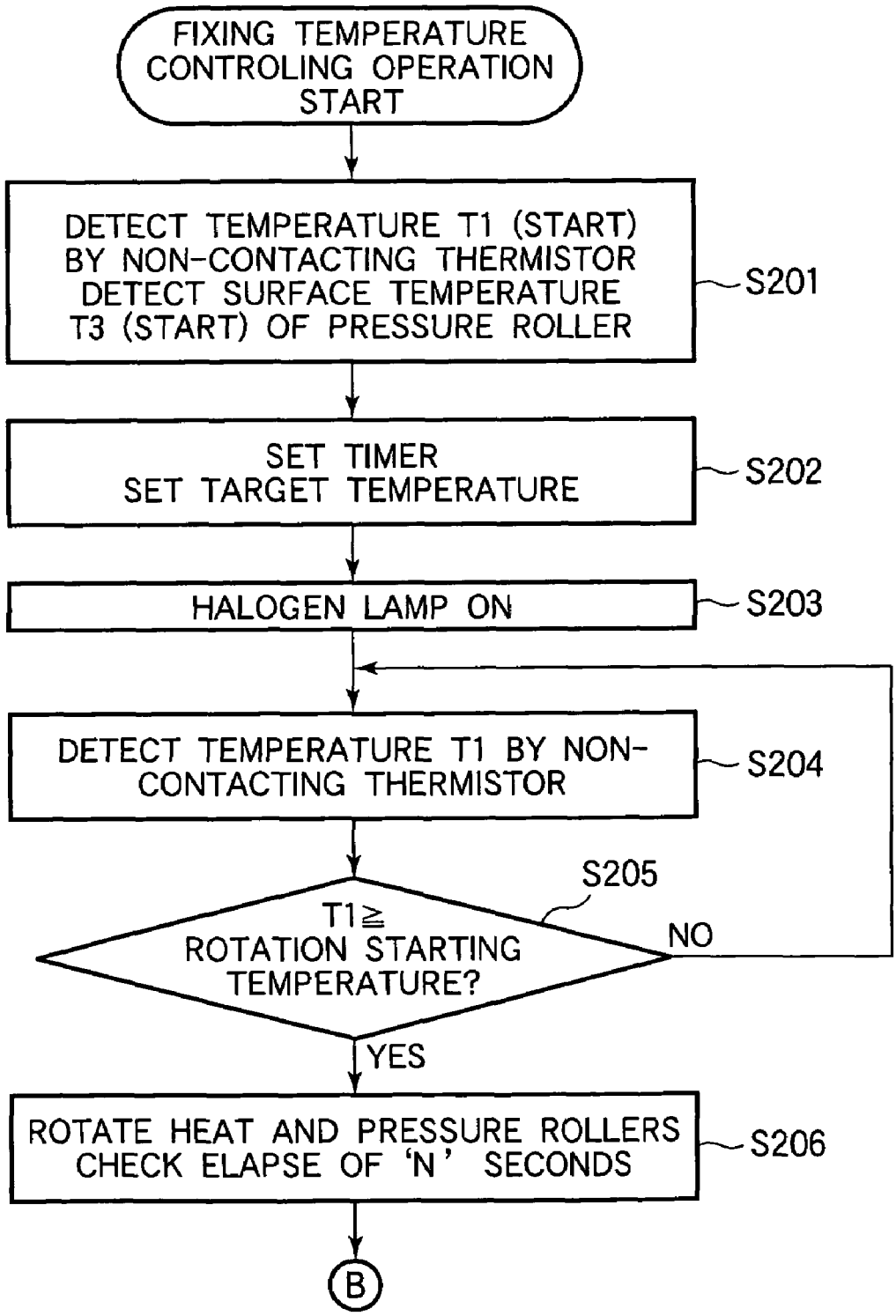
FIG. 21 is a flow chart illustrating a temperature controlling operation of the fixing device performed by a printing controller based on a calculated surface temperature obtained by an equation (3) or (5) selected according to an accumulated roller temperature index in Embodiment 4.

FIGS. 21 and 22 are flow charts illustrating the temperature controlling operation of the fixing unit 500 performed by the printing controller 504 (FIG. 15) based on the calculated surface temperature T determined by one of the equations (3)

and (5) selected according to the accumulated roller temperature index Q determined by the equation (4). The temperature controlling operation of the fixing controller 500 will be described with reference to the flow charts of FIGS. 21 and 22.

When the printing controller 504 receives the printing control command (the printing start command) from the superior device, the printing controller 504 (FIG. 15) starts the temperature controlling operation of the fixing unit 500. In particular, the printing controller 504 reads the detected temperature T1 (start) detected by the non-contacting thermistor 54 and the detected temperature T3 (start) of the pressure roller 22 and stores the temperatures T1 and T3 (step S201). Next, the printing controller 504 sets the timer 116*a* in the fixing controller 116 to the operation time interval Tm (for example, 400 ms) of the temperature controlling. The printing controller 504 further determines the fixing temperature based on the kind of the recording medium (for example, a thick paper, a thin paper or an OHP sheet) and the printing condition (for example, a color printing or a monochrome printing) and set the fixing temperature as the fixing target temperature. The printing controller 101 stores the fixing target temperature in the resistor 116*b* in the fixing controller 116 (step S202).

Next, the printing controller 504 turns on the halogen lamp 53 to heat the heat roller 21 (step S203). Then, the printing controller 504 reads the detected temperature T1 detected by the non-contacting thermistor 54. The printing controller 504 repeats the reading of the detected temperature T1 detected by the non-contacting thermistor 54 until the detected temperature T1 reaches the predetermined rotation starting temperature (steps S204 and S205). The rotation starting temperature is previously set for the purpose of ensuring that the heat roller 21 starts rotating after the toner on the heat roller 21 has molten. When the detected temperature T1 reaches the rotation starting temperature, the printing controller 504 starts driving the fixing motor 122 so that the heat roller 21 and the pressure roller 22 rotate as indicated by arrows, and checks whether N seconds (sufficient for the pressure roller 22 to be uniformly heated) has elapsed or not (step S206).

Then, the printing controller 504 starts the timer 116*a* (step S207). The printing controller 504 stops the timer 116*a* when the counted time reaches the predetermined operation time interval Tm (for example, 400 ms) (steps S208 and S209). The printing controller 504 reads the detected temperature T1 detected by the non-contacting thermistor 54 and the detected temperature T3 detected by the contacting-type thermistor 501 (step S210). The printing controller 504 calculates the accumulated roller temperature index Q based on the above described equation (4) (step S211):

$$Q=\{c\times T1(\text{start})+\tau\times T3(\text{start})\}+\int\{\kappa(T1+T3)\}dt$$

Then, the printing controller 504 determines whether the accumulated roller temperature index Q is less than 100 (step S212). When the accumulated roller temperature index Q is less than 100, the printing controller 504 calculates the calculated surface temperature T of the heat roller 21 based on the above described equation (3) (step S213).

$$T(^\circ\text{ C.})=T1(^\circ\text{ C.})+a\times T_N3(^\circ\text{ C.})+b$$

When the accumulated roller temperature index Q is greater than or equals to 100, the printing controller 504 calculates the calculated surface temperature T of the heat roller 21 based on the above described equation (4) (step S214).

$$T(^\circ\text{ C.})=T1(^\circ\text{ C.})+d(^\circ\text{ C.})$$

Next, the printing controller 504 compares the calculated surface temperature T and the predetermined fixing target temperature (step S215). When the calculated surface temperature T is lower than the fixing target temperature, the printing controller 504 turns on the halogen lamp 53 (step S216). When the calculated surface temperature T is higher than or equals to the fixing target temperature, the printing controller 504 turns off the halogen lamp 53 (step S217). Then, the printing controller 504 determines whether the printing operation is to be continued or not (step S218). If the printing controller 504 determines that the printing operation is to be continued, the printing controller 504 repeats the processes of steps S207 through S218. If the printing controller 504 determines that the printing operation is to be ended, the printing controller 504 turns off the halogen lamp 53 and stops the fixing motor 122 (step S219), so that the fixing temperature controlling operation is ended. In the step S218, whether the printing operation is to be ended or not is determined based on whether the trailing end of the recording medium 205 is detected by a not-shown sensor and whether there is a subsequent printing data.

As described above, according to the fixing device of Embodiment 4, whether the fixing unit is in the warm operating condition (in which the surrounding temperature T2 is saturated and stabilized) or in the cold operating condition (in which the warm operating condition has not been reached) is determined based on the accumulated roller temperature index Q, and the calculated surface temperature T is determined by the equation suitable for the operating condition. Accordingly, it becomes possible to further correctly compensate the detected temperature.

Embodiment 5

The difference between the fixing device of Embodiment 5 and the fixing device of Embodiment 4 is in the signal processing method performed by the printing controller 504. Therefore, in the description of the signal processing method of the fixing device according to Embodiment 5, FIG. 14 (i.e., the sectional view of the fixing device 500) and FIG. 15 (i.e., the block diagram of the control system of the image forming portion 505) are referred to. Duplicated explanations are omitted, and the emphasis of the description is on the difference of the fixing devices of Embodiments 4 and 5. Although the signal processing method of the printing controller of Embodiment 5 is different from that of the printing controller 504 of Embodiment 3, the printing controller of Embodiment 5 is denoted by reference numeral 54 for convenience.

In the fixing device of Embodiment 4, the temperature compensating method is selected based on the operating condition (i.e., the cold operating condition or the warm operating condition) according to the accumulated roller temperature index Q. However, if the halogen lamp is instantaneously turned off and immediately turned on at the cold operating condition, there may be the cases where the detected temperature T1 (start) of the heat roller 21 detected by the non-contacting thermistor 54 is, for example, 170° C., and the detected temperature T3 (start) of the pressure roller 22 is, for example, 50° C. In such a case, the initial value of the accumulated roller temperature index Q obtained by equation (4) is (170+50)/2=110 (when $c=\tau=0.5$), which is greater than the predetermined value Qs=100 (when $c=\tau=0.5$, $\kappa=5000$).

In such a case, the warm operating compensation is performed even though the cold operating temperature compensation must be performed. It is difficult to perfectly prevent such an incorrect operation even when the values of the constants c and τ are optimized by experimentally assigning weights to the constants c and τ, and therefore another criteria is needed. Embodiment 5 is intended to provide another criteria for preventing the above described incorrect operation, as described below.

Figure 23A:
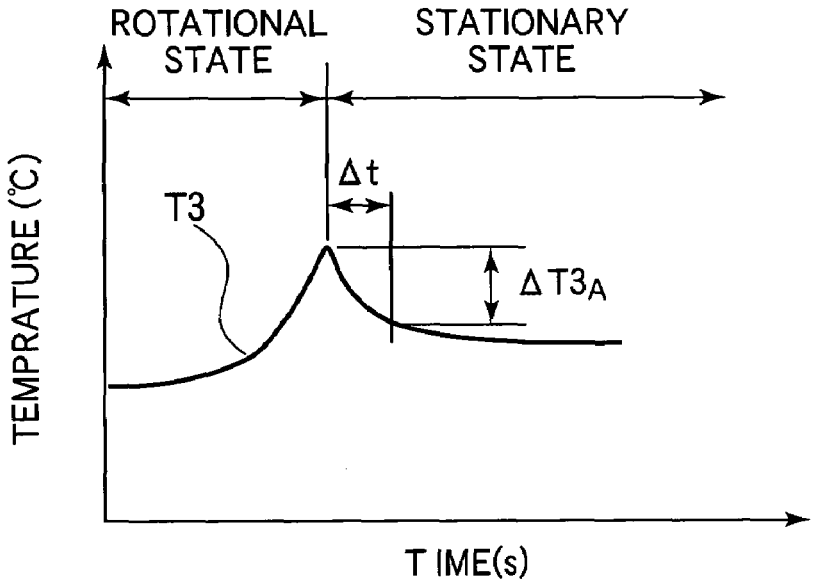
FIG. 23A illustrates a change with time of the detected temperature of a pressure roller when a fixing motor shifts from a rotational state to a stationary state in a cold operating condition in Embodiment 5.
Figure 23B:
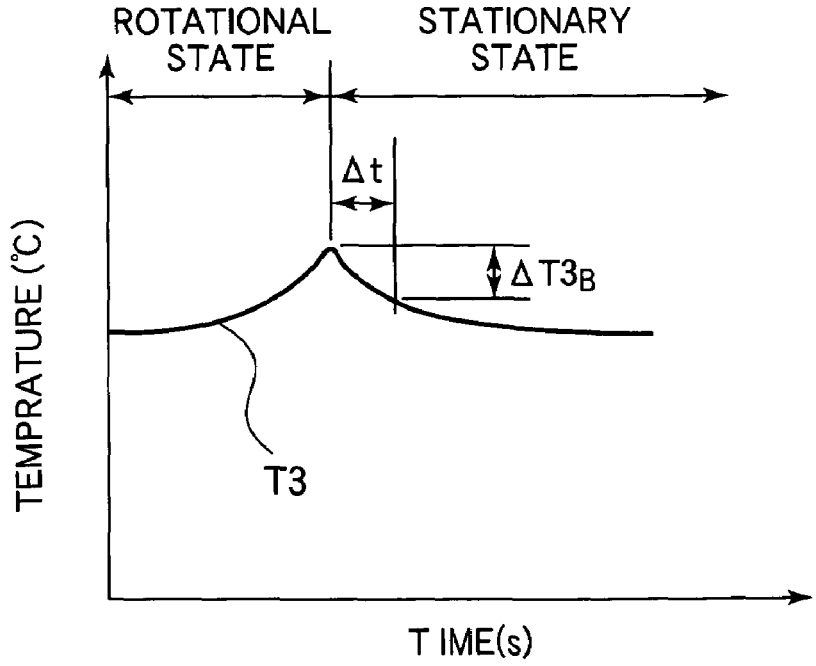
FIG. 23B illustrates a change with time of the detected temperature of the pressure roller when the fixing motor shifts from the rotational state to the stationary state in a warm operating condition in Embodiment 5.

FIGS. 23A and 23B are graphs illustrating the result of an experiment using the fixing unit 500. FIG. 23A illustrates a change of the detected temperature T3 of the pressure roller 22 when the fixing motor 122 (FIG. 15) shifts from the rotational state to the stationary state (in which the rotation is stopped) in the cold operating condition. FIG. 23B illustrates a change of the detected temperature T3 of the pressure roller 22 when the fixing motor 122 (FIG. 15) shifts from the rotational state to the stationary state in the warm operating condition. In this case, the rotational state is kept for approximately 20 seconds. Further, in the rotational state, the heat roller 21 is at the above described rotation starting temperature.

As shown in FIGS. 23A and 23B, the detected temperature T3 of the pressure roller 22 (FIG. 14) increases when the pressure roller 22 is rotating, because the pressure roller 22 draws heat from the heat roller 21 having the heat source. However, the detected temperature T3 of the pressure roller 22 (FIG. 14) decreases when the fixing motor 122 stops and the pressure roller 22 stops, because the detected temperature T3 of the pressure roller 22 is detected by the contacting-type thermistor 501 disposed at a position remote from the nip portion between the heat roller 21 and the pressure roller 22.

In the cold operating condition, the amount of decrease in the detected temperature T3 of the pressure roller 22 when time Δt has elapsed after the fixing motor 122 stops is referred to as $\Delta T3_A$. In the warm operating condition, the decrease in the detecting temperature T3 of the pressure roller 22 when time Δt has elapsed after the fixing motor 122 stops is referred to as $\Delta T3_B$. There is a following relationship:

$$\Delta T3_A > \Delta T3_B$$

This relationship indicates that the decrease in the detected temperature T3 of the pressure roller 22 is greater in the cold operating condition than in the warm operating condition. It is understood that there is a longer delay of the temperature decrease in the warm operating condition than in the cold operating condition because the pressure roller 22 is heated to the core in the warm operating condition. The rate ΔT of the temperature decrease is expressed as follows:

$$\Delta T = \Delta T3/(T1 - T3) \times 100(\%) \quad (6)$$

Figure 24:
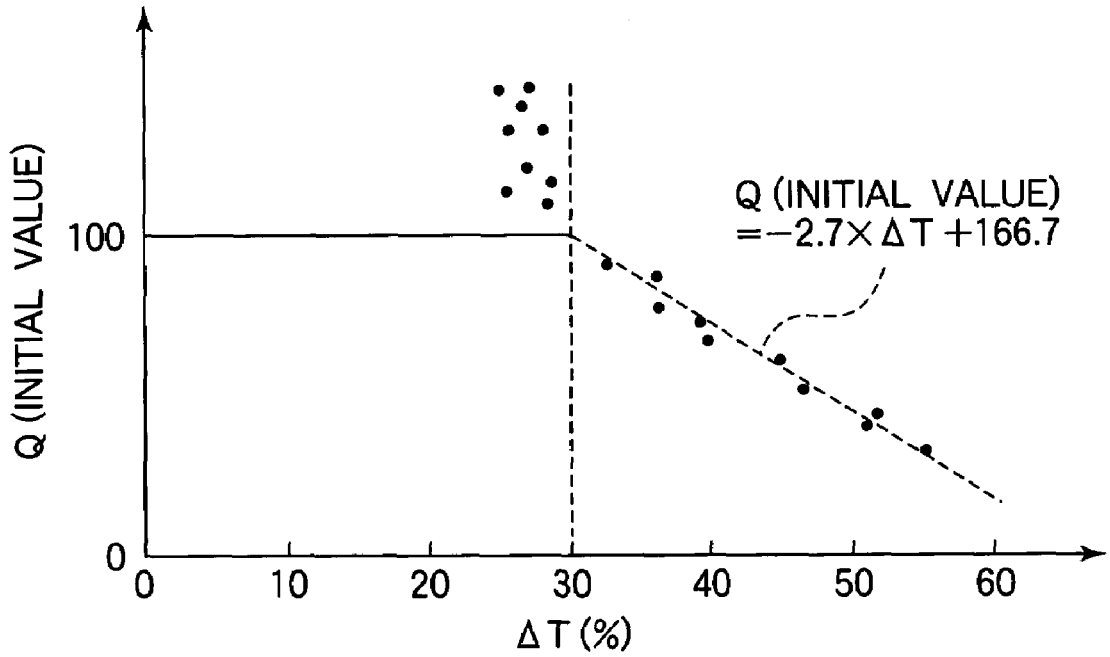
FIG. 24 is a graph illustrating the experimentally obtained relationship between a rate of decrease in temperature of the pressure roller obtained by equation (6) and an initial value of the accumulated roller temperature index when the decrease in temperature of the pressure roller is detected in Embodiment 5.

FIG. 24 illustrates the experimentally obtained relationship between the rate ΔT of decrease in temperature of the pressure roller 22 obtained by the equation (6) and the initial value of the accumulated roller temperature index Q when the rate ΔT3 is calculated. As shown in FIG. 24, in a region in which the rate ΔT of decrease in temperature of the pressure roller is greater than or equals to 30%, the ratio ΔT and the initial value of Q are in a proportional relationship, and are approximately expressed as follows:

$$Q(\text{initial value}) = -2.7 \times \Delta T + 166.7 \quad (7)$$

In this region in which the rate ΔT of decrease in temperature of the pressure roller is greater than or equals to 30%, the value of Q is less than a predetermined value Qs(Qs=100 when c=τ=0.5, κ=5000), and corresponds to the above described cold operating condition. In contrast, in a region in which the rate ΔT of decrease in temperature of the pressure roller is less than 30% (corresponding to the warm operating condition), the initial value of accumulated roller temperature index Q takes a random value greater than or equals to 100.

Therefore, in the region in which the rate ΔT of decrease in temperature of the pressure roller is greater than or equals to 30%, the initial value of the accumulated roller temperature index Q is determined by the equation (7). Further, the determined initial value of the accumulated roller temperature index Q replaces a first term {c×T1(start)+τ×T3(start)} of the equation (4), and the accumulated roller temperature index Q is determined by the equation (4). When the rate ΔT of decrease in temperature of the pressure roller is greater than or equals to 30%, the initial value of the accumulated roller temperature index Q is less than 100, and therefore the temperature controlling operation starts from the cool operating temperature compensation. In contrast, when the rate ΔT of decrease in temperature of the pressure roller is less than 30%, it is understood that the initial value of the accumulated roller temperature index Q is greater than 100, and therefore the temperature controlling operation starts from the warm operating temperature compensation.

As described above, the initial value of the accumulated roller temperature index Q is determined based on the rate ΔT of decrease in temperature of the pressure roller, and therefore the suitable accumulated roller temperature index Q can be obtained even when the instantaneous power shutdown occurs. Therefore, it becomes possible to perform the compensation of the detected temperature without causing the incorrect operation.

Figure 25:
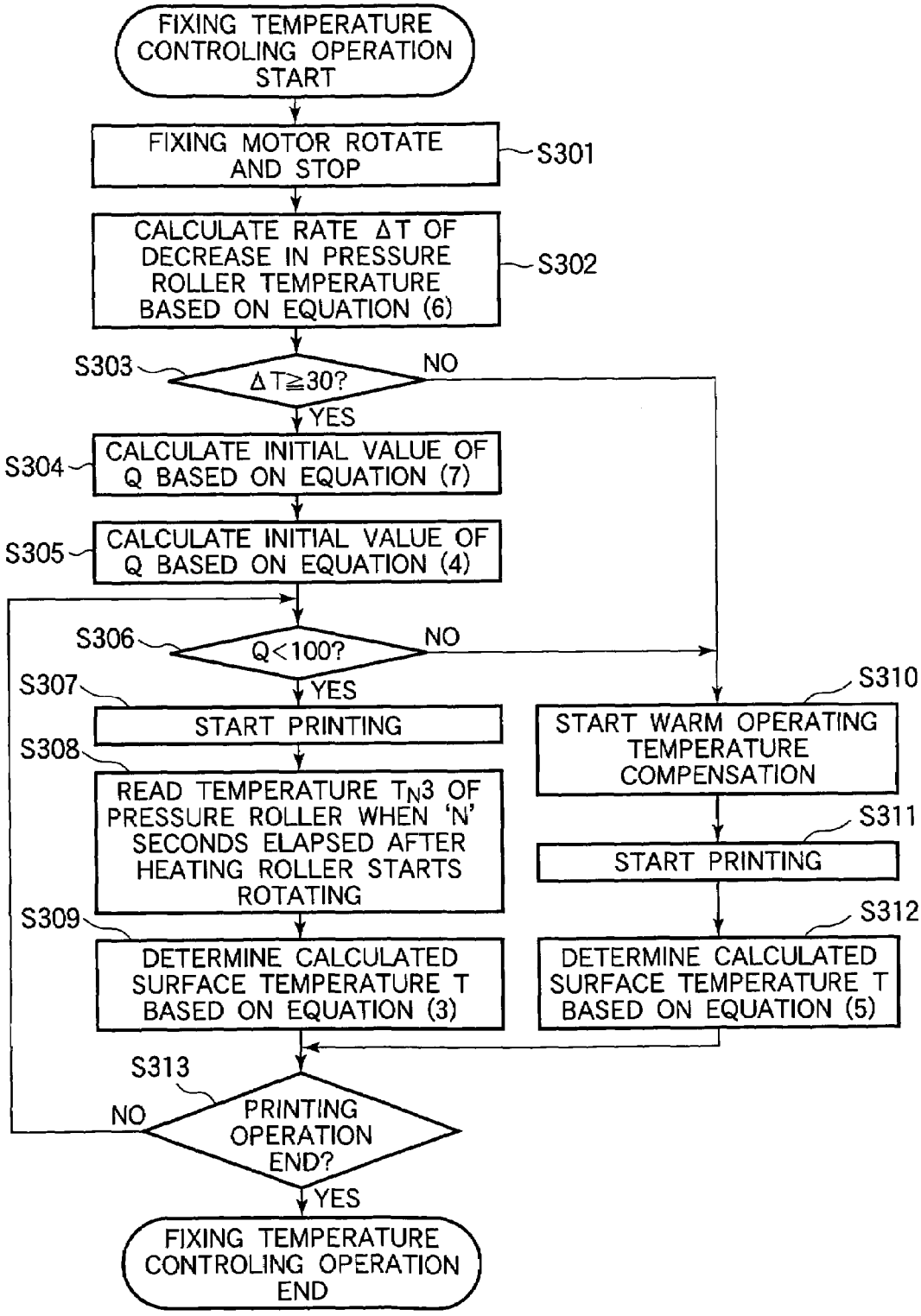
FIG. 25 is a flow chart illustrating a process for determining a calculated surface temperature obtained by the equation (3) or (5) selected according to an accumulated roller temperature index and a rate of decrease in temperature of the pressure roller obtained by equation (6) in Embodiment 5.

FIG. 25 is a flow chart illustrating the process for determining the calculated surface temperature T using one of the equations (3) and (5) selected in consideration of the rate ΔT of decrease in temperature of the pressure roller (i.e., the additional criteria). The method for determining the calculated surface temperature T of the heat roller in the fixing unit 500 will be described with reference to the flow chart of FIG. 25.

When the printing controller 504 receives the printing control command (the printing start command) from the superior device, the printing controller 504 (FIG. 15) starts determining the calculated surface temperature T. In particular, the printing controller 504 rotates the fixing motor 122 for a predetermined period (for example, almost 20 seconds) and stops the fixing motor 122 (step S301). In this step, the rotation of the fixing motor 122 is performed on condition that the halogen lamp 53 is turned on and the surface temperature of the heat roller 21 reaches to the above described rotation starting temperature. Then, when time Δt has elapsed after the fixing motor 122 stops, the printing controller 504 determines the amount ΔT3 of decrease in the detected temperature T3, and determines the rate ΔT of decrease in temperature of the pressure roller 22 according to the above described equation (6) (step S302).

Then, the printing controller 504 determines whether the rate ΔT of decrease in temperature of the pressure roller is greater than or equal to 30(ΔT≧30) (step S303). If the rate ΔT of the temperature decrease is less than 30, the printing controller 504 immediately starts the warm operating temperature compensation (step S310). In particular, the printing controller 504 starts printing operation (step S311), and obtains the calculated surface temperature T of the heat roller 21 by compensating the detected temperature T1 detected by the non-contacting thermistor 54 using the equation (5).

If the rate ΔT of the temperature decrease is greater than or equals to 30 in the above described step 303, the printing controller 504 determines the initial value of the accumulated roller temperature index Q at this step (step S304) using the above described equation (7). The determined value of the accumulated roller temperature index Q replaces the first term {c×T1(start)+τ×T3(start)} of the equation (4), so that the accumulated roller temperature index Q is determined using the equation (4).

Then, the printing controller 504 determines whether the accumulated roller temperature index Q is greater than 100 (step S306). When the accumulated roller temperature index Q is greater than 100, the printing controller 504 proceeds to the above described step S310 to start the warm operating temperature compensation, and obtain the calculated surface temperature T of the heat roller 21 using the above described equation (5) via the steps S311 and S312. When the accumulated roller temperature index Q is less than or equals to 100, the printing controller 504 starts printing operation (step S307), and obtains the detected temperature $T_N$3 of the pressure roller 22 when N seconds have elapsed after the heat roller 21 starts rotating (step S308), and obtain the calculated surface temperature T of the heat roller 21 by compensating the detected temperature T1 of the heat roller 21 detected by the non-contacting thermistor 54 using the above described equation (3) (step S309). Then, the printing controller 504 determines whether the printing operation is to be continued or not (step S313). If the printing controller 504 determines that the printing operation is to be continued, the printing controller 504 repeats the processes of steps S306 through S313. If the printing controller 504 determines that the printing operation is to be ended, the printing controller 504 turns off the halogen lamp 53 and stops the fixing motor 122, so that the fixing temperature controlling operation is ended.

The flow chart of FIG. 25 is for illustrating the process of obtaining the calculated surface temperature T, and therefore the processes regarding the on-off control of the halogen lamp 53 and the operation of the timer are omitted from the flow chart of FIG. 5.

As described above, according to the fixing device of Embodiment 5, the rate ΔT of decrease in temperature of the pressure roller 22 when the fixing motor is stopped after having rotated for a predetermined time after the power of the fixing device is turned on, and the initial value of the accumulated roller temperature index Q is determined based on the rate ΔT of decrease in temperature of the pressure roller 22. Therefore, even when the instantaneous shutdown occurs, it is possible to obtain the suitable accumulated roller temperature index Q. Thus, it becomes possible to perform the compensation of the detected temperature without causing the incorrect operation.

While the preferred embodiments of the present invention have been illustrated in detail, it should be apparent that modifications and improvements may be made to the invention without departing from the spirit and scope of the invention as described in the following claims.

What is claimed is:

1. A fixing device for fixing a developer image to a recording medium, said fixing device comprising:

a heat source;

a heating member heated by said heat source so as to heat said recording medium;

a pressing member disposed in contact with said heating member so as to form a contact portion between said pressing member and said heating member, a cover provided so as to cover said heating member, said cover having an insertion opening through which said recording medium is fed into said cover and an election opening through which said recording medium is fed out of said cover, said cover having a partition wall so that a substantially enclosed space is formed by said partition wall and a surface of said heating member, said partition wall being configured to isolate said substantially enclosed space from said insertion opening and said ejection opening;

a first temperature detecting unit that detects a temperature of said heating member and is remote from said heating member;

a second temperature detecting unit disposed in said substantially enclosed space, said second temperature detecting unit being disposed in the proximity of said first temperature detecting unit and disposed above a portion of the circumferential surface of said heating member in opposition to said contact portion; and a control unit that controls said heat source according to detected temperatures detected by said first and second temperature detecting units.

2. The fixing device according to claim 1, wherein said second temperature detecting unit detects a surrounding temperature of said heating member.

3. The fixing device according to claim 1, further comprising a cover that supports said heating member or covers said heating member to reduce the radiation of heat from said heating member, wherein said second temperature detecting unit detects a temperature of said cover.

4. The fixing device according to claim 3, wherein said first and second temperature detecting units are substantially aligned on a line perpendicular to a tangential plane of a part of a circumferential surface of said heating member.

5. The fixing device according to claim 4, further comprising a partition wall that defines a space in which said part of said circumferential surface of said heating member, said first temperature detecting unit and said second temperature detecting unit are disposed.

6. The fixing device according to claim 1, wherein said first and second temperature detecting units respectively comprise thermistors.

7. An image forming apparatus having said fixing device according to claim 1, said image forming apparatus further comprising:

a medium feeding unit that feeds said recording medium; and an image forming unit that forms a developer image on said recording medium, wherein said fixing device fixes said developer image on said recording medium.

8. The fixing device according to claim 1, wherein said first temperature detecting unit and said second temperature detecting unit are arranged in a substantially vertical direction with respect to said contact portion.

9. The fixing device according to claim 1, wherein said first and second temperature detecting units are disposed above an opposite portion to said contact portion on the circumferential surface of said heating member.

10. A fixing device for fixing a developer image to a recording medium, said fixing device comprising:

a heat source;

a heating member heated by said heat source so as to heat said recording medium;

a first temperature detecting unit that detects a temperature of said heating member and is remote from said heating member;

a second temperature detecting unit disposed in the proximity of said first temperature detecting unit; and a control unit that controls said heat source according to detected temperatures detected by said first and second temperature detecting units, wherein said control unit controls said heating member based on a calculated surface temperature T of said heating member determined by the following equation:

$$T=T1+(T1-T2)\times(L1/L2)\times C$$

where T1 indicates a detected temperature detected by said first temperature detecting unit, T2 indicates a detected temperature detected by said second temperature detecting unit, L1 indicates a distance between said heating member and said first temperature detecting unit, L2 indicates a distance between said first and second temperature detecting units in a radial direction of said heating member, and C is a constant.

11. A fixing device for fixing a developer image to a recording medium, said fixing device comprising:

a heat source;

a heating member heated by said heat source so as to heat said recording medium;

a pressing member disposed in contact with said heating member so as to form a contact portion between said pressing member and said heating member, a cover provided so as to cover said heating member, said cover having a partition wall so that a substantially enclosed space is formed by said partition wall and a surface of said heating member;

a first temperature detecting unit that detects a temperature of said heating member and is remote from said heating member;

a second temperature detecting unit disposed in said substantially enclosed space, said second temperature detecting unit being disposed in the proximity of said first temperature detecting unit and disposed above a portion of the circumferential surface of said heating member in opposition to said contact portion;

a control unit that controls said heat source according to detected temperatures detected by said first and second temperature detecting units; and an adjusting mechanism for adjusting the distance between a surface of said heating member and said first temperature detecting unit.

12. A fixing device for fixing a developer image to a recording medium, said fixing device comprising:

a heat source:

a heating member heated by said heat source so as to heat said recording medium;

a first temperature detecting unit that detects a temperature of said heating member and is remote from said heating member;

a second temperature detecting unit disposed in the proximity of said first temperature detecting unit;

a cover that supports said heating member or covers said heating member to reduce radiation of heat from said heating member, said second temperature detecting unit detecting a temperature of said cover; and a control unit that controls said heat source according to detected temperatures detected by said first and second temperature detecting units, wherein said first and second temperature detecting units are constituted by a common temperature detecting unit, wherein said fixing device further comprises a moving mechanism that moves said common temperature detecting unit between a first position in the vicinity of a surface of said heating member and a second position in which said common temperature detecting unit contacts said cover, and wherein said common temperature detecting unit acts as said first temperature detecting unit when said common temperature detecting unit is in said first position, and acts as said second temperature detecting unit when said common temperature detecting unit is in said second position.

13. A fixing device for fixing a developer image to a recording medium, said fixing device comprising:

a heat source;

a heating member heated by said heat source so as to heat said recording medium;

a first temperature detecting unit that detects a temperature of said heating member, and is remote from said heating member;

a third temperature detecting unit that detects a temperature transmitted from said heating member; and a control unit that compensates a detected temperature detected by said first temperature detecting unit based on a detected temperature detected by said third temperature detecting unit, and controls said heat source based on a compensated detected temperature, wherein said control unit controls said heating member based on a calculated surface temperature T of said heating member based on the following equation:

$$T=T1+a\times T3+b$$

where T1 indicates a detected temperature detected by said first temperature detecting unit, T3 indicates a detected temperature detected by said third temperature detecting unit, and a and b are constants.

14. The fixing device according to claim 13, wherein said control unit determines an accumulated value Q of a detected temperature T1 detected by said first temperature detecting unit and a detected temperature T3 detected by said third temperature detecting unit, and wherein, when said accumulated value Q is greater than or equals to a predetermined threshold, said control unit controls said heating member based on a calculated surface temperature T determined by the following equation:

$$T=T1+d$$

where d is a constant.

15. The fixing device according to claim 14, wherein said heating member and a pressure member respectively comprise rollers, and said control unit compensates said accumulated value Q based on a rate of decrease in said detected temperature T3 when said rollers stop rotating after said rollers rotate for a predetermined time.

16. The fixing device according to claim 15, wherein said rate ΔT of decrease in said detected temperature T3 is determined based on the following equation:

$$\Delta T=\Delta T3/(T1-T3)\times 100,$$

where ΔT3 indicates the amount of decrease in said detected temperature T3, and wherein, when ΔT is greater than or equals to a predetermined value, said control unit determines an initial value of said accumulated value Q as follows:

$$Q(\text{initial value})=-e\times\Delta T+f$$

where e and f are constants.

* * * * *